US007922309B2

(12) United States Patent
Furukawa

(10) Patent No.: US 7,922,309 B2
(45) Date of Patent: Apr. 12, 2011

(54) INK REFILL KIT CAPABLE OF EFFICIENTLY SIPHONING INK FROM AN INK BOTTLE

(75) Inventor: Juichi Furukawa, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 12/139,131

(22) Filed: Jun. 13, 2008

(65) Prior Publication Data

US 2008/0309737 A1 Dec. 18, 2008

(30) Foreign Application Priority Data

Jun. 15, 2007 (JP) ..... 2007-158909

(51) Int. Cl.
*B41J 2/175* (2006.01)

(52) U.S. Cl. ..... 347/86; 347/85

(58) Field of Classification Search ..... 347/85–87
See application file for complete search history.

(56) References Cited

U.S. PATENT DOCUMENTS

| | | | | | |
|---|---|---|---|---|---|
| 5,400,573 | A * | 3/1995 | Crystal et al. | ..... | 53/468 |
| 5,838,352 | A * | 11/1998 | Martinez | ..... | 347/87 |
| 5,886,719 | A * | 3/1999 | Zepeda | ..... | 347/85 |
| 5,967,196 | A * | 10/1999 | Moser | ..... | 141/18 |
| 6,929,357 | B2 * | 8/2005 | Qingguo et al. | ..... | 347/85 |
| 2001/0013884 | A1 * | 8/2001 | Crystal et al. | ..... | 347/85 |
| 2006/0087530 | A1 | 4/2006 | Furukawa | | |

FOREIGN PATENT DOCUMENTS

| | | |
|---|---|---|
| JP | 53-148313 | 11/1978 |
| JP | 6-76013 | 10/1994 |
| JP | 9-174868 | 7/1997 |
| JP | 2000-141680 | 5/2000 |
| JP | 2004-358802 | 12/2004 |

* cited by examiner

*Primary Examiner* — Ellen Kim
(74) *Attorney, Agent, or Firm* — Cooper & Dunham LLP

(57) ABSTRACT

An ink refill kit for injecting ink into an ink cartridge includes an ink bottle and an injector. The ink bottle stores ink. The injector siphons the ink from the ink bottle and injects the ink into the ink cartridge. The ink bottle includes an opening, an inner bottom surface, and a single deepest portion. The opening allows the injector to pass therethrough. The inner bottom surface is provided on an inner bottom of the ink bottle. The single deepest portion is provided in the inner bottom surface opposite the opening and having a depth greater than that of the inner bottom surface.

6 Claims, 20 Drawing Sheets

INK REFILL KIT CAPABLE OF EFFICIENTLY SIPHONING INK FROM AN INK BOTTLE

BACKGROUND

1. Technical Field

The present specification describes an ink refill kit, and more particularly, an ink refill kit for efficiently siphoning ink out of an ink bottle.

2. Discussion of the Background

An image forming apparatus, such as a copier, a printer, a facsimile machine, or a multifunction printer having at least one of copying, printing, scanning, and facsimile functions, typically forms an image on a recording medium (e.g., a sheet) using a liquid discharging device. The liquid discharging device includes a liquid discharging head (e.g., a recording head) for discharging liquid (e.g., an ink drop) onto a conveyed sheet. The ink is adhered to the sheet to form an image on the sheet.

A known image forming apparatus includes an ink cartridge for storing ink to be supplied to the liquid discharging device and an ink refill kit for supplying the ink to the ink cartridge. When the liquid discharging device consumes all the ink stored in the ink cartridge, the ink refill kit supplies fresh ink to the ink cartridge, so as to reuse the ink cartridge, thereby achieving reduction of running costs and effective utilization of resources.

FIG. 1 illustrates a related-art ink refill kit 100R. The related-art ink refill kit 100R includes an ink bottle 501R and a syringe 502R. The syringe 502R siphons ink 500 out of the ink bottle 501R and injects the ink 500 into an ink cartridge through a needle. However, the ink bottle 501R has a flat bottom surface, as illustrated in FIG. 1. Consequently, when a small amount of ink 500 remains in the ink bottle 501R, the ink bottle 501R needs to be lifted up and inclined so that the syringe 502R can reach the remaining ink 500. When a point of the needle of the syringe 502R does not reach the ink 500, the syringe 502R fails to siphon all the ink 500 from the ink bottle 501R, as illustrated in FIG. 1. If the ink bottle 501R is excessively inclined to almost fall over, the remaining ink 500 may spill from the ink bottle 501R.

In addition, when the syringe 502R is removed from the ink bottle 501R, the ink 500 adhering to an outside of the syringe 502R may adhere to a user's hand or to other peripheral devices.

Obviously, such insufficient suction of ink is undesirable, and accordingly, there is a need for a technology to efficiently siphon the ink from the ink bottle.

BRIEF SUMMARY

This patent specification describes an ink refill kit. One example of an ink refill kit includes an ink bottle and an injector. The ink bottle is configured to store ink. The injector is configured to siphon the ink from the ink bottle and inject the ink into the ink cartridge. The ink bottle includes an opening, an inner bottom surface, and a single deepest portion. The opening is configured to allow the injector to pass therethrough. The inner bottom surface is provided on an inner bottom of the ink bottle. The single deepest portion is provided in the inner bottom surface opposite the opening and configured to have a depth greater than that of the inner bottom surface.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
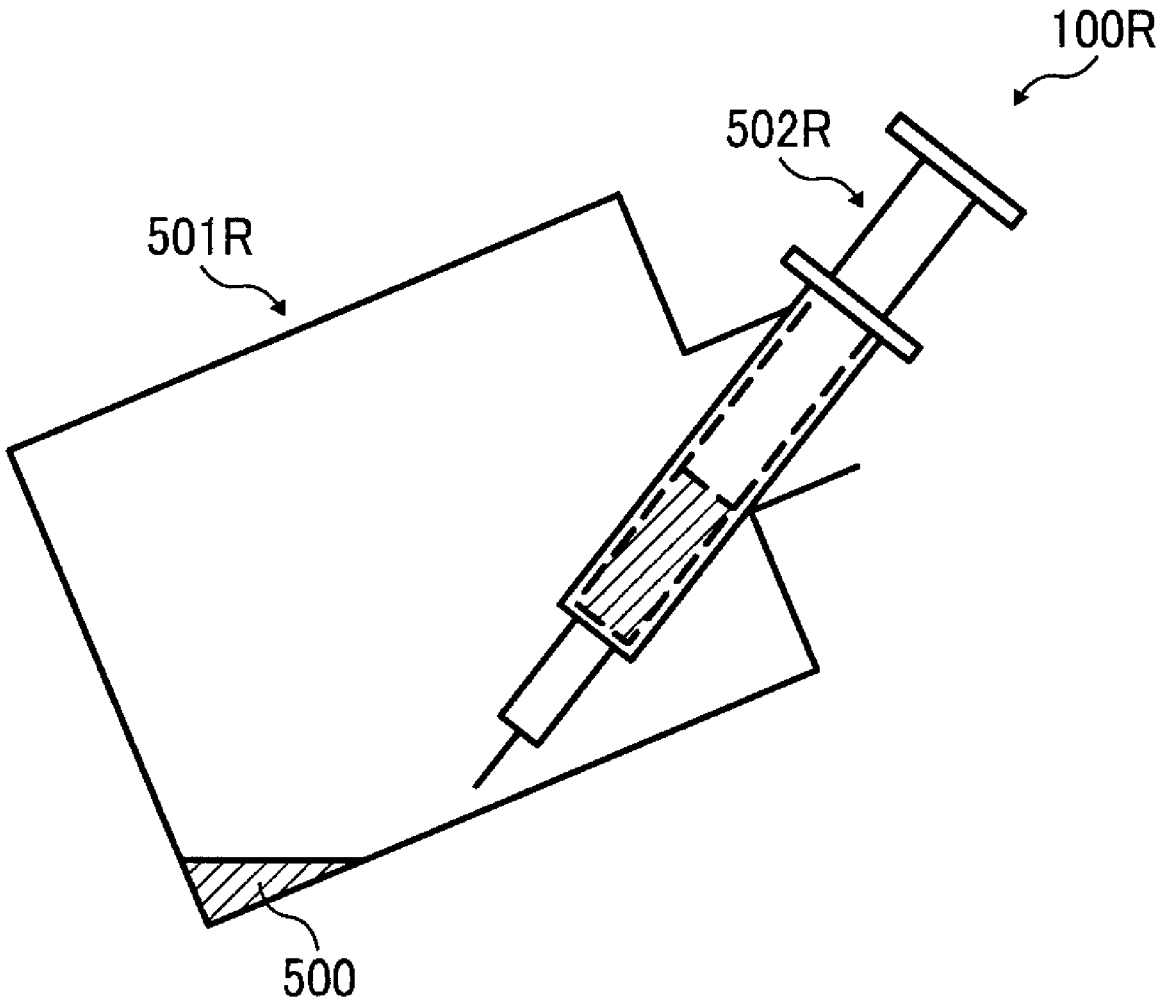
FIG. 1 RELATED ART
FIG. 1 is a schematic view of a related-art ink refill kit.

In describing examples and exemplary embodiments illustrated in the drawings, specific terminology is employed for the sake of clarity. However, this disclosure is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIGS. 2, 3, 4, and 5, an ink refill kit 100 according to an exemplary embodiment is explained.

Figure 2:
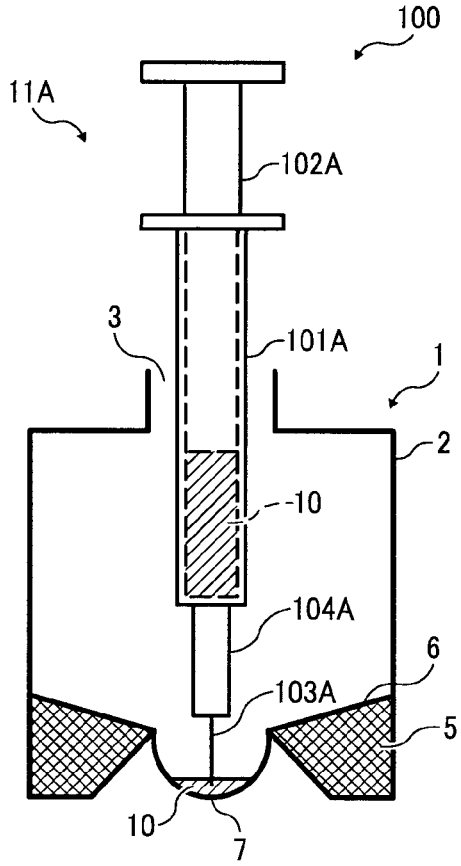
FIG. 2 is a schematic view of an ink refill kit according to an exemplary embodiment of the present disclosure.
Figure 3:
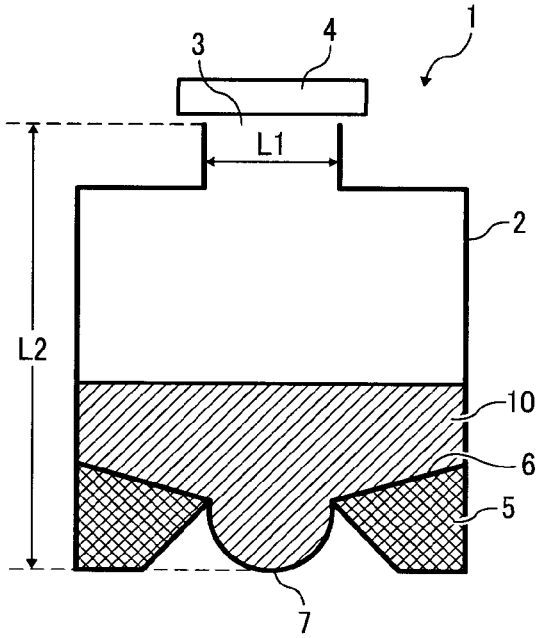
FIG. 3 is a sectional view of an ink bottle included in the ink refill kit shown in FIG. 2.
Figure 4:
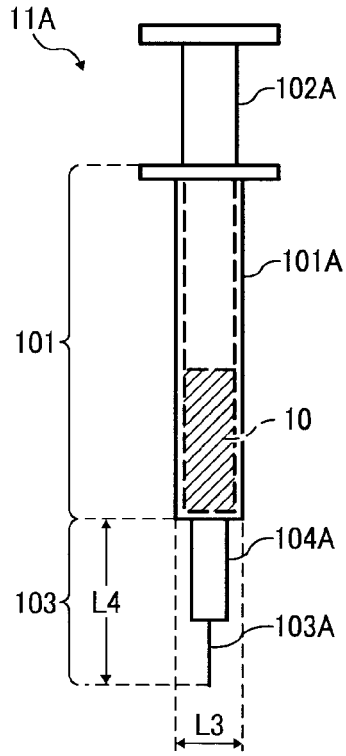
FIG. 4 is a sectional view of an injector included in the ink refill kit shown in FIG. 2.

FIG. 2 is a schematic view of the ink refill kit 100. The ink refill kit 100 includes an ink bottle 1 and an injector 11A. The ink bottle 1 includes a container 2, an opening 3, a leg portion 5, an inner bottom surface 6, and a deepest portion or well 7. The injector 11A includes a cylinder 101A, a piston 102A, a needle 103A, and a needle mount 104A. FIG. 3 is a sectional view of the ink bottle 1. The ink bottle 1 further includes a lid 4. FIG. 4 is a sectional view of the injector 11A. The injector 11A further includes a body portion 101 and a narrow tube portion 103.

As illustrated in FIG. 4, the cylinder 101A and the piston 102A form the body portion 101 of the injector 11A. The needle 103A and the needle mount 104A form the narrow tube portion 103 of the injector 11A.

As illustrated in FIG. 3, the container 2 stores ink 10. The opening 3 is provided in a central portion of an upper surface of the container 2. The lid 4 seals the opening 3. The leg portion 5 is provided in a bottom of the container 2. The well 7 is provided in a single area of the bottom of the container 2, opposing the opening 3, and deeper than the inner bottom surface 6. The inner bottom surface 6 slopes down toward the well 7, so that the ink 10 may collect in the well 7.

As illustrated in FIG. 4, the piston 102A slidably moves up and down inside the cylinder 101A. The needle 103A is attached to a bottom end of the cylinder 101A via the needle mount 104A in an axial direction of the cylinder 101A and includes a through-hole (not shown) connected to an inside of the cylinder 101A.

Accordingly, as illustrated in FIG. 2, the injector 11A siphons the ink 10 into the cylinder 101A through the needle 103A by pulling the piston 102A from the cylinder 101A. When the cylinder 101A is supplied with the ink 10, the injector 11A injects the ink 10 into an ink cartridge (not shown) through a point of the needle 103A by pushing the piston 102A into the cylinder 101A. A commercially available injector, for example, may be used as the injector 11A.

The opening 3 of the ink bottle 1 has a diameter L1 (depicted in FIG. 3) substantially greater than a diameter L3 (depicted in FIG. 4) of the cylinder 101A of the injector 11A (e.g., L1>L3), so that the injector 11A may be inserted into the container 2 of the ink bottle 1 through the opening 3. It is to be noted that the plane of the opening 3 of the ink bottle 1 and the cylinder 101A of the injector 11A is cylindrical. Alternatively, when the opening 3 of the ink bottle 1 and the cylinder 101A of the injector 11A have a planar shape other than cylindrical, a size of a sectional area of the opening 3 of the ink bottle 1 may be substantially greater than that of a sectional area of the cylinder 101A of the injector 11A.

Therefore, as illustrated in FIG. 2, when the ink bottle 1 is placed on a horizontal surface without being inclined, the injector 11A is inserted into the ink bottle 1 through the opening 3. By pulling the piston 102A of the injector 11A out of the cylinder 101A, the injector 11A siphons the ink 10 from the ink bottle 1 into the cylinder 101A. After the injector 11A is removed from the ink bottle 1, the injector 11A injects the ink 10 into the ink cartridge.

As described above, since the well 7 is provided in a single portion of the inner bottom surface 6 opposing the opening 3, when a small amount of the ink 10 remains in the container 2, the remaining ink 10 collects in the single well 7. Moreover, since the inner bottom surface 6 slopes down toward the well 7, the remaining ink 10 further collects in the single well 7.

In addition, since the body portion 101 (depicted in FIG. 4) of the injector 11A is inserted into the ink bottle 1 through the opening 3 when the ink bottle 1 is placed on a horizontal surface, the point of the needle 103A of the injector 11A can reach the well 7 of the ink bottle 1.

Accordingly, even when the ink bottle 1 is not inclined, the injector 11A may siphon the ink 10 collected in the well 7 of the ink bottle 1.

Furthermore, the opening 3 of the ink bottle 1 is provided in the vicinity of the central portion of the upper surface of the container 2, thereby providing stability of the ink bottle 1 when the injector 11A is inserted into the ink bottle 1.

Figure 5:
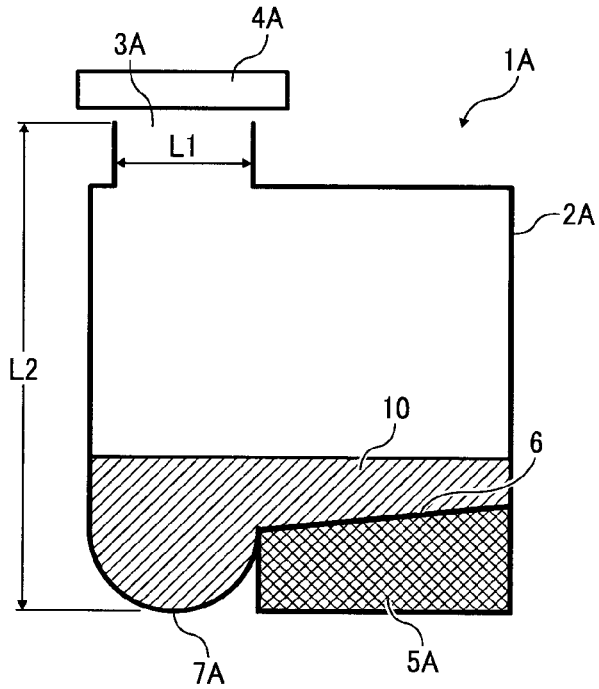
FIG. 5 is a sectional view of an ink bottle as a modification example of the ink bottle shown in FIG. 3.

FIG. 5 illustrates an ink bottle 1A as a modification example of the ink bottle 1 (depicted in FIG. 3) according to this exemplary embodiment. The ink bottle 1A includes a container 2A, an opening 3A, a lid 4A, a leg portion 5A, an inner bottom surface 16, and a well 7A. The opening 3A of the ink bottle 1A is provided at one end of an upper surface of the container 2A. However, compared to the ink bottle 1 (depicted in FIG. 3) including the opening 3 provided in the central portion of the upper surface of the container 2, the ink bottle 1A becomes unstable, causing the ink bottle 1A to fall over when the injector 11A (depicted in FIG. 2) is inserted into the ink bottle 1A.

Preferably, as illustrated in FIG. 2, the injector 11A has a length sufficient to allow the point of the needle 103A to reach the well 7 of the container 2 without insertion of a user's hand into the ink bottle 1.

According to the above-described exemplary embodiment, an ink refill kit (e.g., the ink refill kit 100) includes an ink bottle (e.g., the ink bottle 1) for storing ink in a container (e.g., the container 2) and an injector (e.g., the injector 11A) for siphoning the ink out of the ink bottle 1 and injecting the ink into an ink cartridge. The ink bottle 1 includes an opening (e.g., the opening 3) through which the injector 11A siphons the ink and a single deepest portion (i.e., the well 7) opposing the opening 3 and deeper than an inner bottom surface (the inner bottom surface 6) of the container 2. Therefore, even when a small amount of ink remains in the ink bottle 1, the ink may collect in the single well 7, so that the injector 11A can reach and siphon the ink without inclination of the ink bottle 1, thereby preventing the ink from spilling out of the container 2.

Figure 6:
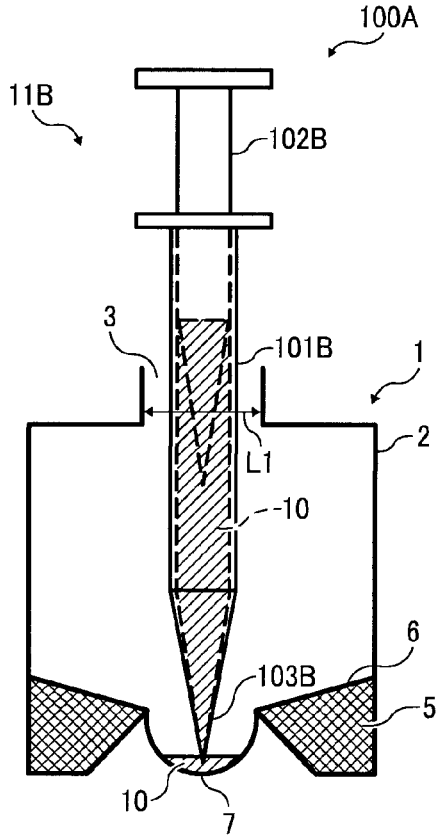
FIG. 6 is a schematic view of an ink refill kit according to another exemplary embodiment.
Figure 7:
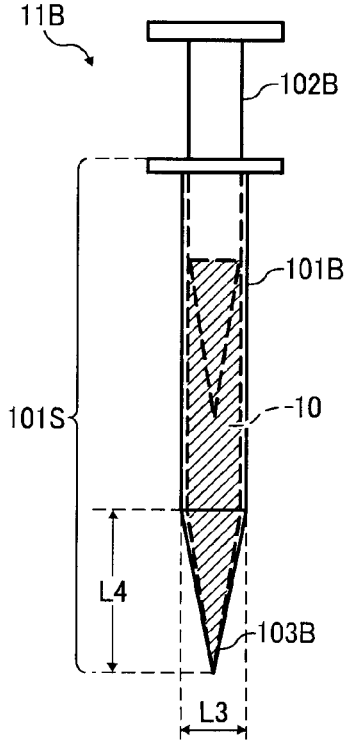
FIG. 7 is a sectional view of an injector included in the ink refill kit shown in FIG. 6.

Referring to FIGS. 6 and 7, a description is now given of an ink refill kit 100A according to another exemplary embodiment. FIG. 6 is a schematic view of the ink refill kit 100A. The ink refill kit 100A includes an injector 11B instead of the injector 11A (depicted in FIG. 2). The injector 11B includes a cylinder 101B and a piston 102B. The cylinder 101B includes a pointed portion 103B. FIG. 7 is a schematic view of the injector 11B. The injector 11B further includes a body portion 101S. The other elements of the ink refill kit 100A are equivalent to those of the ink refill kit 100 depicted in FIG. 2.

The piston 102B slidably moves up and down inside the cylinder 101B. The cylinder 101B and the piston 102B form the body portion 101S of the ink refill kit 100A. The pointed portion 103B of the injector 11B is provided at a point of the cylinder 101B to be integrated into the cylinder 101B and has a conical shape including a hole (not shown) inside. Like the shape of the pointed portion 103B of the cylinder 101B, a point of the piston 102B also has a conical shape.

Therefore, as illustrated in FIG. 6, the injector 11B may take ink 10 into the cylinder 101B through the pointed portion 103B by pulling the piston 102B out of the cylinder 101B. When the cylinder 101B is supplied with the ink 10, the injector 11B may inject the ink 10 into an ink cartridge through a point of the pointed portion 103B of the cylinder 101B by pushing the piston 102B into the cylinder 101B.

Like the ink refill kit 100 (depicted in FIG. 2) according to the above-described exemplary embodiment, a diameter L1 (depicted in FIG. 6) of the opening 3 of the ink bottle 1 is substantially greater than a diameter L3 (depicted in FIG. 7) of the cylinder 101B of the injector 11B (e.g., L1>L3), so that the body portion 101S (depicted in FIG. 7) of the injector 11B may be inserted into the container 2 of the ink bottle 1 through the opening 3. Therefore, as illustrated in FIG. 6, the pointed portion 103B of the injector 11B may reach the well 7 of the ink bottle 1 to allow the injector 11A to suck (e.g., take out) the ink 10 collected in the well 7 of the ink bottle 1.

According to this exemplary embodiment, although the injector 11B does not include the narrow tube portion 103 (depicted in FIG. 3), the injector 11B may suck the ink 10 from the ink bottle 1. Moreover, the injector 11B may have a length sufficient to allow the point of the injector 11B to reach the well 7 of the container 2 without insertion of a user's hand into the ink bottle 1.

Figure 8:
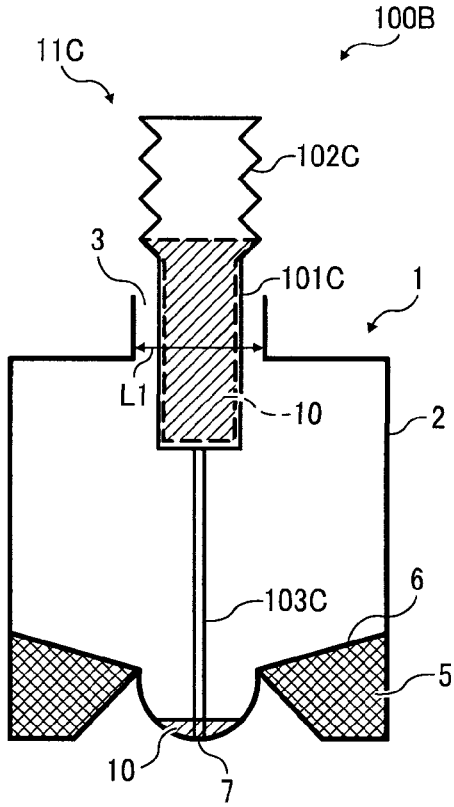
FIG. 8 is a schematic view of an ink refill kit according to yet another exemplary embodiment.
Figure 9:
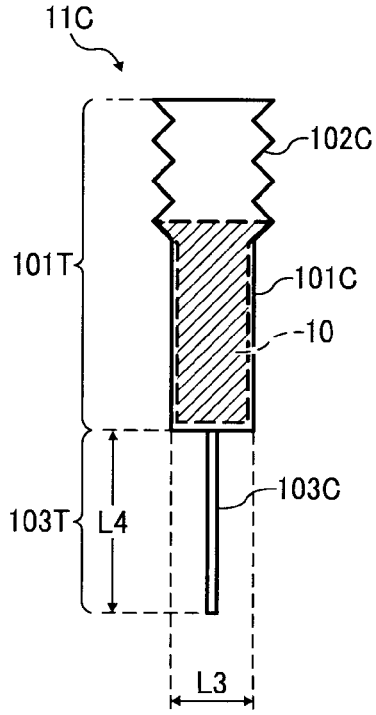
FIG. 9 is a sectional view of an injector included in the ink refill kit shown in FIG. 8.

Referring to FIGS. 8 and 9, a description is now given of an ink refill kit 100B according to yet another exemplary embodiment. FIG. 8 is a schematic view of the ink refill kit 100B. The ink refill kit 100B includes an injector 11C. The injector 11C includes a cylinder 101C, an elastic member 102C, and a needle-like member 103C. FIG. 9 is a schematic view of the injector 11C. The injector 11C further includes a body portion 101T and a narrow tube portion 103T. The other elements of the ink refill kit 100B are equivalent to those of the ink refill kit 100 depicted in FIG. 2.

The elastic member 102C is provided at an open end of the cylinder 101C and has an accordion-like shape or a bellows-like shape. The elastic member 102C and the cylinder 101C form the body portion 101T of the ink refill kit 100B. The needle-like member 103C is provided at one end of the cylinder 101C opposite to the elastic member 102C to form the narrow tube portion 103T of the injector 11C and includes a hole (not shown) inside. For example, the injector 11C may be a syringe.

When a top surface of the elastic member 102C of the injector 11C is pressed and then released, in other words, when the elastic member 102C is expanded and contracted, the ink 10 may be taken into the cylinder 101C through the needle-like member 103C. When the cylinder 101C is supplied with the ink 10, the injector 11C may inject the ink 10 into an ink cartridge through the needle-like member 103C by pressing the top surface of the elastic member 102C of the injector 11C and thereby contracting the elastic member 102C.

Like the ink refill kit 100 (depicted in FIG. 2), a diameter L1 (depicted in FIG. 8) of the opening 3 of the ink bottle 1 is substantially greater than a diameter L3 (depicted in FIG. 9) of the cylinder 101C of the injector 11C (e.g., L1>L3), so that the body portion 101T of the injector 11C may be inserted into the container 2 of the ink bottle 1 through the opening 3. Therefore, as illustrated in FIG. 8, the needle-like member 103C of the injector 11C may reach the well 7 of the ink bottle 1 to allow the injector 11C to suck (e.g., take out) the ink 10 collected in the well 7 of the ink bottle 1.

Moreover, the injector 11C may have a length sufficient to allow the needle-like member 103C of the injector 11C to reach the well 7 of the container 2 without insertion of a user's hand into the ink bottle 1.

Accordingly, since a thickness (e.g., the diameter L3) of the body portion 101T of the injector 11C is smaller than a diameter (e.g., the diameter L1) of the opening 3 of the ink bottle 1, the body portion 101T of the injector 11C may be inserted into the ink bottle 1, so that the injector 11C may efficiently siphon the ink 10 collected in the well 7 of the ink bottle 1.

Figure 10:
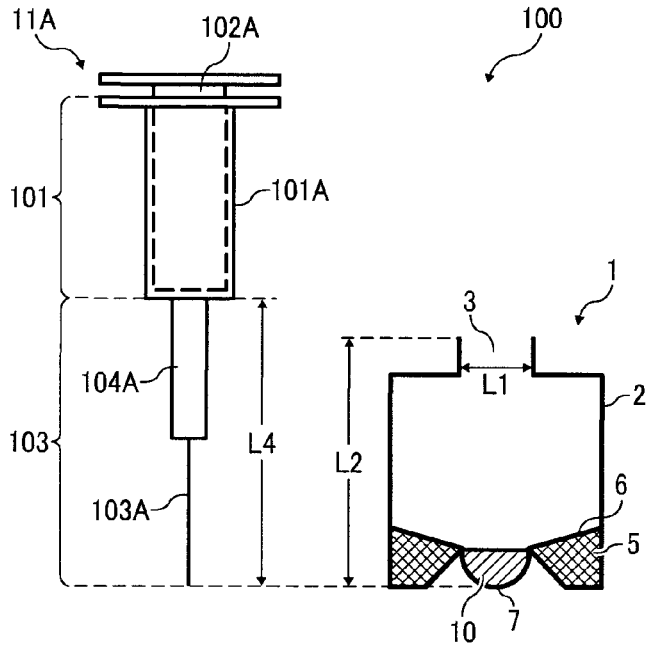
FIG. 10 is a schematic view of a modification example of the ink refill kit shown in FIG. 2.
Figure 11A:
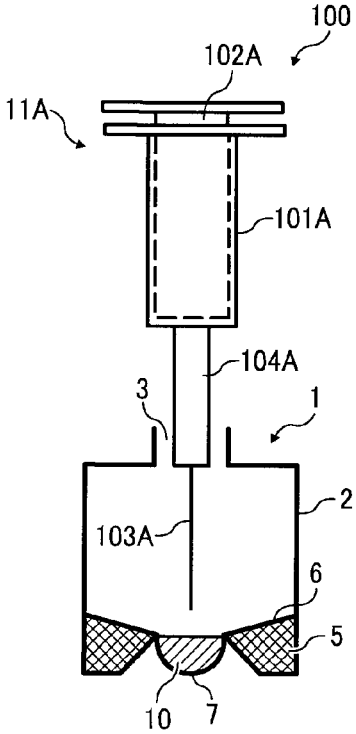
FIG. 11A is a sectional view of the ink refill kit shown in FIG. 10 when an injector included in the ink refill kit is inserted into an ink bottle included in the ink refill kit.
Figure 11B:
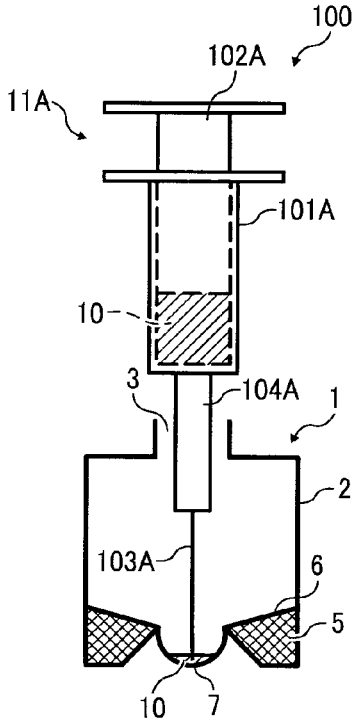
FIG. 11B is a sectional view of the ink refill kit shown in FIG. 11A when the injector shown in FIG. 11A siphons ink from the ink bottle shown in FIG. 11A.
Figure 12A:
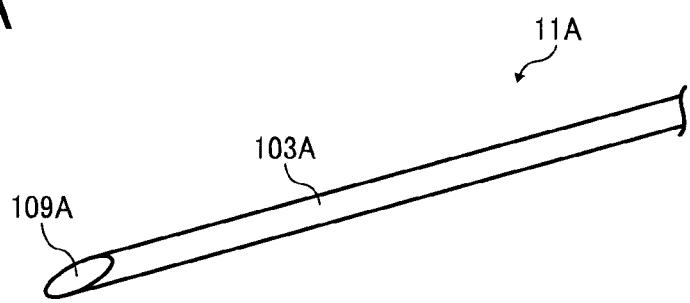
FIG. 12A is a perspective view of one example of a point of a needle included in the injector shown in FIG. 4.
Figure 12B:
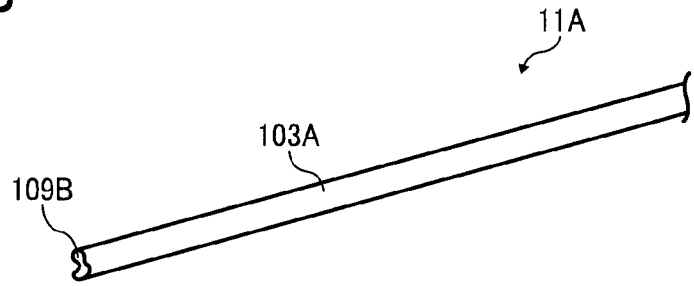
FIG. 12B is a perspective view of another example of a point of a needle included in the injector shown in FIG. 4.
Figure 12C:
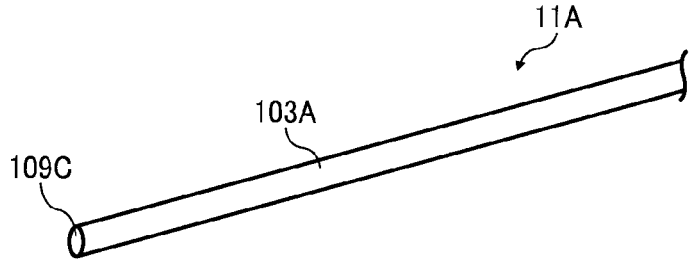
FIG. 12C is a perspective view of yet another example of a point of a needle included in the injector shown in FIG. 4.
Figure 12D:
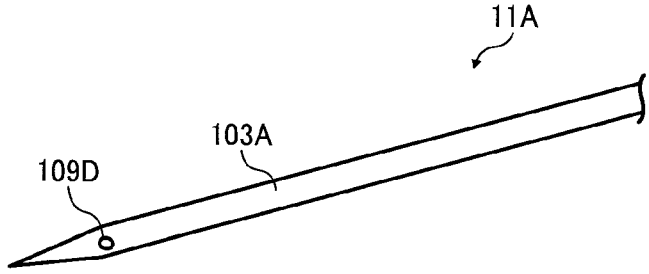
FIG. 12D is a perspective view of yet another example of a point of a needle included in the injector shown in FIG. 4.

Referring to FIGS. 10, 11A, and 11B, a description is now given of a modification example of the ink refill kit 100 depicted in FIG. 2. FIG. 10 is a schematic view thereof. FIG. 11A is a sectional view thereof when the injector 11A is inserted into the ink bottle 1. FIG. 11B is a sectional view thereof when the injector 11A siphons the ink 10 from the ink bottle 1.

As illustrated in FIG. 10, the narrow tube portion 103 of the injector 11A has a length L4 greater than a distance L2 between an inner bottom surface of the well 7 of the ink bottle 1 and a top edge of the opening 3 of the ink bottle 1. When the ink refill kit 100 is used, as illustrated in FIGS. 11A and 11B, the narrow tube portion 103 of the injector 11A is inserted into the container 2 of the ink bottle 1 through the opening 3 of the ink bottle 1, so that the injector 11A may siphon the ink 10 out of the ink bottle 1.

Since the length L4 of the narrow tube portion 103 of the injector 11A is greater than the distance L2 between the inner bottom surface of the well 7 of the ink bottle 1 and the top edge of the opening 3 of the ink bottle 1, the narrow tube portion 103 of the injector 11A may reach the well 7 of the ink bottle 1, as illustrated in FIG. 11B, so that the injector 11A may siphon the ink 10 collected in the well 7 of the ink bottle 1. In this case, since merely the narrow tube portion 103 of the injector 11A is inserted into the ink bottle 1 through the opening 3, a size of a sectional area of the opening 3 may be smaller than that of the opening 3 (depicted in FIGS. 2, 6, and 8) according to the above-exemplary embodiments, thereby preventing evaporation of the ink 10 from the ink bottle 1.

FIGS. 12A, 12B, 12C, and 12D illustrate example shapes of the point of the needle 103A of the injector 11A. The needle 103A of the injector 11A may include an ink inlet 19A, 109B, 109C, or 109D. Each of the ink inlets 109A, 109B, 109C, and 109D is provided at the point of the needle 103A. The ink inlet 109A (depicted in FIG. 12A) is cut at an oblique angle. The ink inlet 109B (depicted in FIG. 12B) is cut into a mountain-like shape. The ink inlet 109C (depicted in FIG. 12C) has a plane surface. The ink inlet 109D (depicted in FIG. 12D) has an opening on a circumferential surface of the needle 103A. The injector 11A (depicted in FIG. 11B) may preferably include a notched ink inlet (e.g., the ink inlet 109A depicted in FIG. 12A or the ink inlet 109B depicted in FIG. 12B), so that the injector 11A may siphon the ink 10 even when the needle 103A contacts the inner bottom surface of the container 2.

Accordingly, as illustrated in FIG. 10, the narrow tube portion 103 of the injector 11A has a diameter smaller than that of the body portion 101 thereof and has a length (e.g., the length L4) greater than a distance (e.g., the distance L2) between the top edge of the opening 3 of the ink bottle 1 and the inner bottom surface of the well 7, so that a point of the narrow tube portion 103 may reach the well 7 of the ink bottle 1. Thus, even when the ink bottle 1 is placed on a horizontal surface, the injector 11A may efficiently siphon the ink 10 collected in the well 7 of the ink bottle 1.

Figure 13:
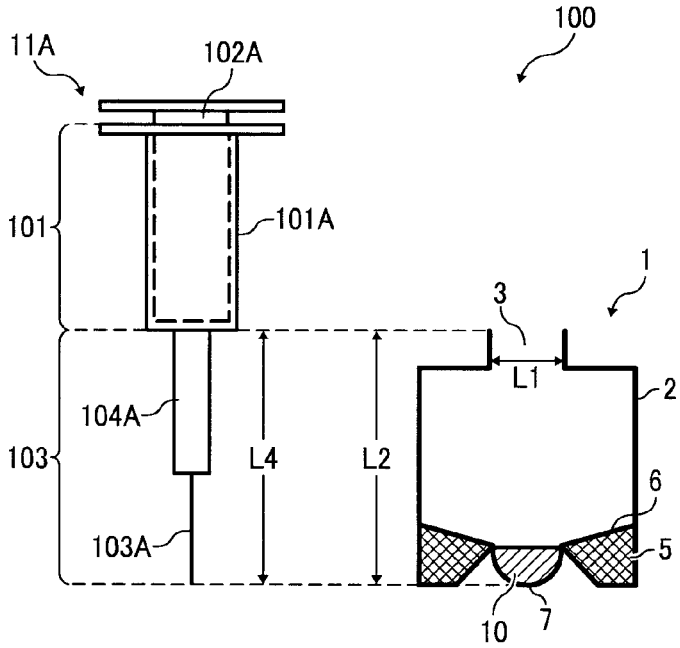
FIG. 13 is a schematic view of another modification example of the ink refill kit shown in FIG. 2.
Figure 14A:
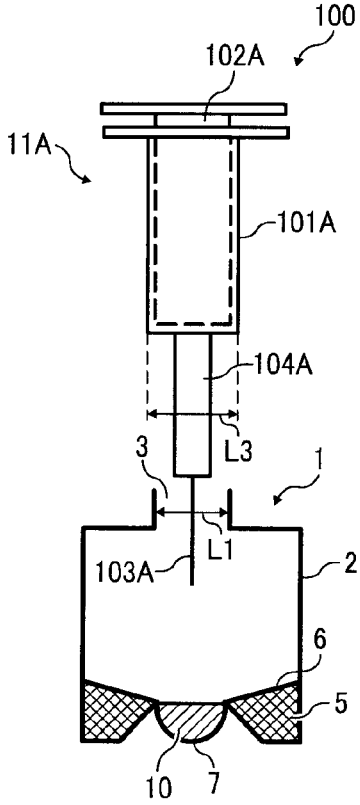
FIG. 14A is a sectional view of the ink refill kit shown in FIG. 13 when an injector included in the ink refill kit is inserted into an ink bottle included in the ink refill kit.
Figure 14B:
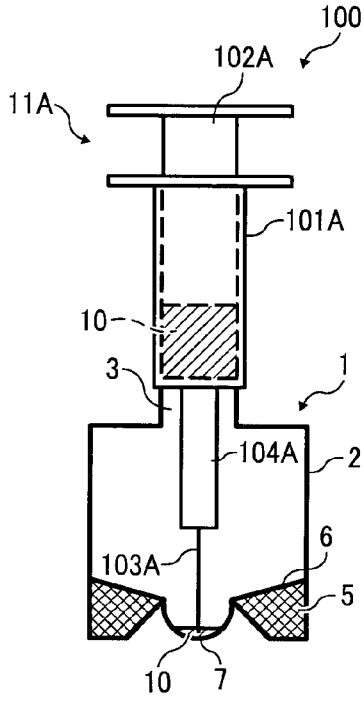
FIG. 14B is a sectional view of the ink refill kit shown in FIG. 14A when the injector shown in FIG. 14A siphons ink from the ink bottle shown in FIG. 14A.

Referring to FIGS. 13, 14A, and 14B, a description is now given of another modification example of the ink refill kit 100 depicted in FIG. 2. FIG. 13 is a schematic view thereof. FIG. 14A is a sectional view thereof when the injector 11A is inserted into the ink bottle 1. FIG. 14B is a sectional view thereof when the injector 11A siphons the ink 10 from the ink bottle 1.

According to this exemplary embodiment, as illustrated in FIG. 14A, the body portion 101 of the injector 11A has a diameter L3 greater than a diameter L1 of the opening 3 of the ink bottle 1. In addition, as illustrated in FIG. 13, the narrow tube portion 103 of the injector 11A has a length L4 equivalent to a distance L2 between the top edge of the opening 3 of the ink bottle 1 and the inner bottom surface of the well 7 of the ink bottle 1.

When the ink refill kit 100 is used, as illustrated in FIGS. 14A and 14B, the narrow tube portion 103 (depicted in FIG. 13) of the injector 11A is inserted into the container 2 of the ink bottle 1 through the opening 3 of the ink bottle 1, so that the injector 11A may siphon the ink 10 from the ink bottle 1.

Since the diameter L3 of the body portion 101 (depicted in FIG. 13) of the injector 11A is greater than the diameter L1 of the opening 3 of the ink bottle 1, the body portion 101 of the injector 11A may contact the top edge of the opening 3 of the ink bottle 1, as illustrated in FIG. 14B. When the body portion 101 of the injector 11A contacts the opening 3 of the ink bottle 1, since the length L4 of the narrow tube portion 103 of the injector 11A is equal to the distance L2 between the top edge of the opening 3 of the ink bottle 1 and the inner bottom surface of the well 7 of the ink bottle 1, the narrow tube portion 103 of the injector 11A may reach the well 7 of the ink bottle 1, so that the injector 11A may siphon the ink 10 collected in the well 7 of the ink bottle 1. Further, since the body portion 101 of the injector 11A contacts the top edge of the opening 3 of the ink bottle 1, as illustrated in FIG. 14B, the injector 11A may not be excessively inserted into the ink bottle 1, thereby preventing bending of the needle 103A of the injector 11A due to contact with the inner bottom surface of the ink bottle 1.

According to this exemplary embodiment, the point of the needle 103A of the injector 11A may be formed by cutting it into a mountain-like shape (e.g., the ink inlet 109B depicted in FIG. 12B), such that the injector 11A may siphon the ink 10 even when the needle 103A of the injector 11A contacts the inner bottom surface of the container 2 of the ink bottle 1C.

Figure 15:
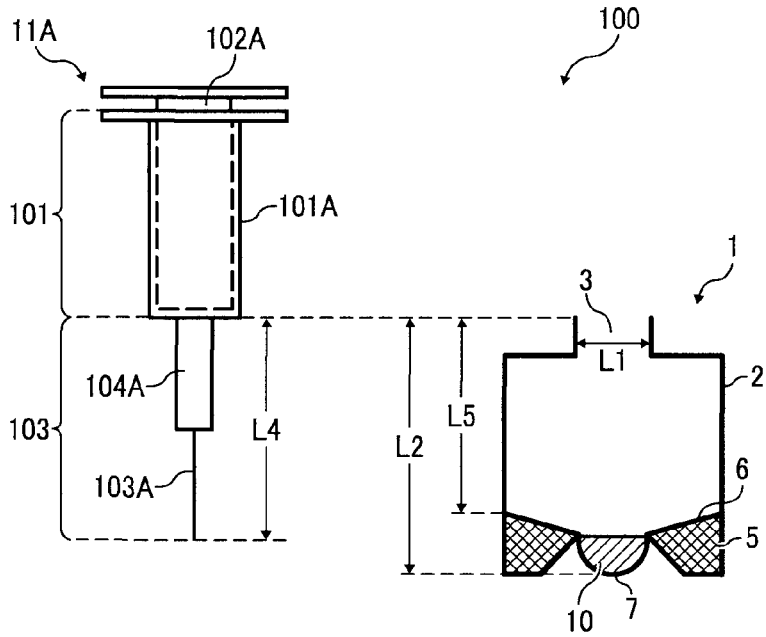
FIG. 15 is a schematic view of yet another modification example of the ink refill kit shown in FIG. 2.
Figure 16A:
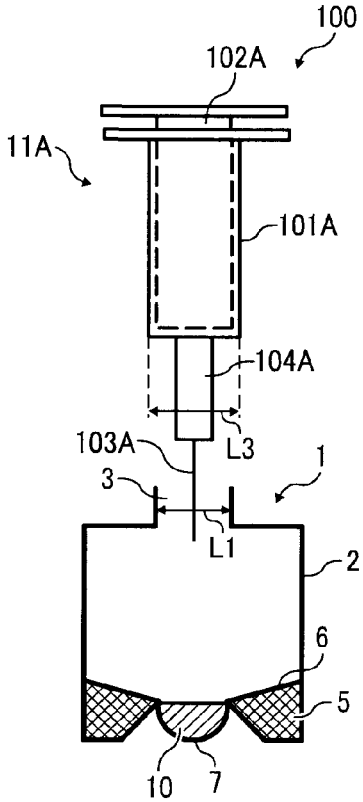
FIG. 16A is a sectional view of the ink refill kit shown in FIG. 15 when an injector included in the ink refill kit is inserted into an ink bottle included in the ink refill kit.
Figure 16B:
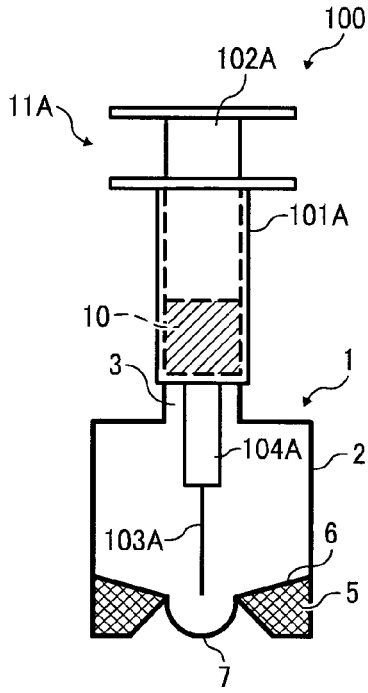
FIG. 16B is a sectional view of the ink refill kit shown in FIG. 16A when the injector shown in FIG. 16A siphons ink from the ink bottle shown in FIG. 16A.

Referring to FIGS. 15, 16A, and 16B, a description is now given of yet another modification example of the ink refill kit 100 depicted in FIG. 2. FIG. 15 is a schematic view thereof. FIG. 16A is a sectional view thereof when the injector 11A is inserted into the ink bottle 1. FIG. 16B is a sectional view thereof when the injector 11A siphons the ink 10 from the ink bottle 1.

According to this exemplary embodiment, as illustrated in FIG. 16A, the body portion 101 (depicted in FIG. 15) of the injector 11A has a diameter L3 greater than a diameter L1 of the opening 3 of the ink bottle 1. As illustrated in FIG. 15, the narrow tube portion 103 of the injector 11A has a length L4 smaller than a distance L2 between the inner bottom surface of the well 7 of the ink bottle 1 and the top edge of the opening 3 of the ink bottle 1 and greater than a distance L5 between the top edge of the opening 3 of the ink bottle 1 and a highest position of the inner bottom surface 6 of the ink bottle 1 (e.g., L2>L4>L5).

When the ink refill kit 100 is used, as illustrated in FIGS. 16A and 16B, the narrow tube portion 103 (depicted in FIG. 15) of the injector 11A is inserted into the container 2 of the ink bottle 1 through the opening 3 of the ink bottle 1, so that the injector 11A may siphon the ink 10 from the ink bottle 1.

Since the diameter L3 of the body portion 101 of the injector 11A is greater than the diameter L1 of the opening 3 of the ink bottle 1, as illustrated in FIG. 16A, the body portion 101 of the injector 11A may contact the top edge of the opening 3 of the ink bottle 1, as illustrated in FIG. 16B. Since the length L4 of the narrow tube portion 103 of the injector 11A is smaller than the distance L2 between the top edge of the opening 3 of the ink bottle 1 and the inner bottom surface of the well 7 of the ink bottle 1 and greater than the distance L5 between the top edge of the opening 3 of the ink bottle 1 and the highest position of the inner bottom surface 6 of the ink bottle 1, as illustrated in FIG. 15, the point of the narrow tube portion 103 of the injector 11A may reach the well 7 of the ink bottle 1, so that the injector 11A may siphon the ink 10 collected in the well 7 of the ink bottle 1, while preventing bending of the needle 103A of the injector 11A due to excessive insertion of the injector 11A into the ink bottle 1.

Since the point of the needle 103A of the injector 11A may have a plane surface shape (e.g., the ink inlet 109C depicted in FIG. 12C), the point of the needle 103A may not stick into a surface of the container 2 of the ink bottle 1.

Accordingly, since the narrow tube portion 103 of the injector 11A has a diameter (e.g., the diameter L3) smaller than a diameter of the body portion 101 thereof and has a length (e.g., the length L4) smaller than a distance (e.g., the distance L2) between the top edge of the opening 3 of the ink bottle 1 and the inner bottom surface of the well 7 of the ink bottle 1 and greater than a distance (e.g., the distance L5) between the top edge of the opening 3 of the ink bottle 1 and the highest position of the inner bottom surface 6 of the ink bottle 1, so that an ink inlet (e.g., the ink inlet 109C depicted in FIG. 12C) may reach apposition lower than a part of the inner bottom surface 6 of the ink bottle 1 when the ink bottle 1 is placed on a horizontal surface, while preventing bending of the narrow tube portion 103 of the injector 11A due to excessive insertion of the injector 11A into the ink bottle 1.

Figure 17:
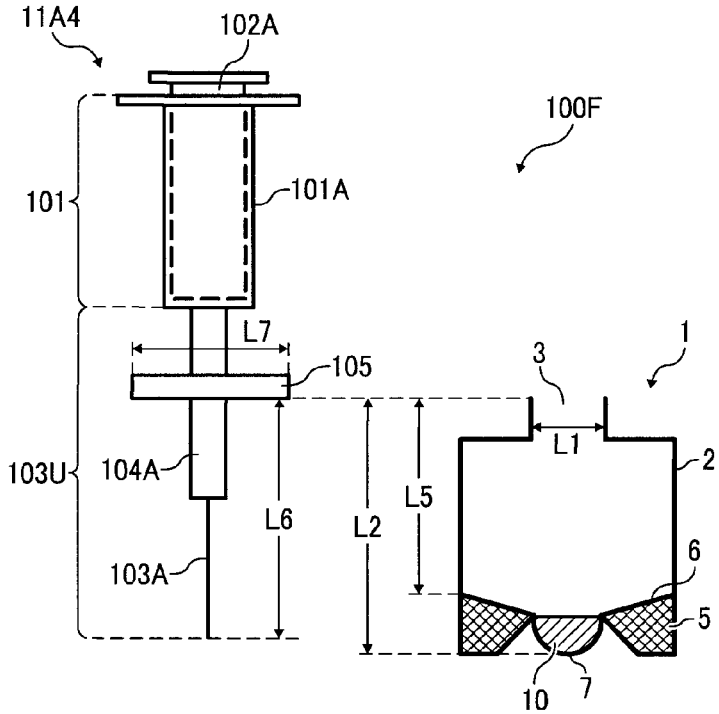
FIG. 17 is a schematic view of an ink refill kit according to yet another exemplary embodiment.
Figure 18A:
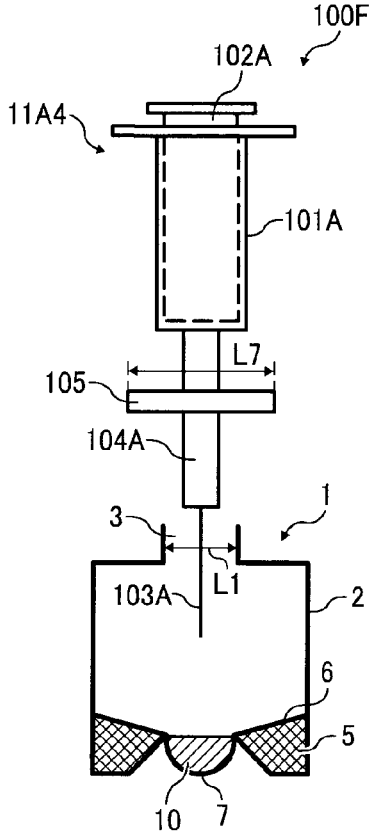
FIG. 18A is a sectional view of the ink refill kit shown in FIG. 17 when an injector included in the ink refill kit is inserted into an ink bottle included in the ink refill kit.
Figure 18B:
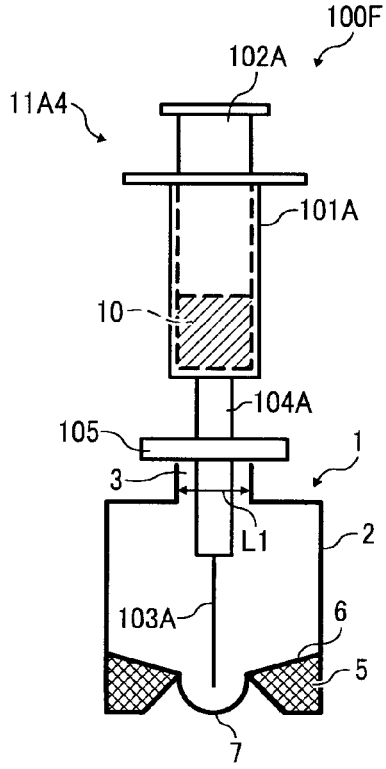
FIG. 18B is a sectional view of the ink refill kit shown in FIG. 18A when the injector shown in FIG. 18A siphons ink from the ink bottle shown in FIG. 18A.

Referring to FIGS. 17, 18A, and 18B, a description is now given of an ink refill kit 100F according to yet another exemplary embodiment. FIG. 17 is a schematic view of the ink refill kit 100F. The ink refill kit 100F includes an injector 11A4. The injector 11A4 includes a narrow tube portion 103U. The narrow tube portion 103U includes a stopper 105. The other elements of the ink refill kit 100F are equivalent to those of the ink refill kit 100 depicted in FIG. 2. FIG. 18A illustrates the ink refill kit 100 when the injector 11A is inserted into the ink bottle 1. FIG. 18B illustrates the ink refill kit 100 when the injector 11A siphons the ink 10 from the ink bottle 1.

As illustrated in FIG. 17, the needle 103A, the needle mount 104A, and the stopper 105 form the narrow tube portion 103U of the injector 11A4. According to this exemplary embodiment, as illustrated in FIG. 17, the narrow tube portion 103U of the injector 11A4 has a length L4 greater than a distance L2 between the top edge of the opening 3 of the ink bottle 1 and the inner bottom surface of the well 7 of the ink bottle 1. However, the stopper 105 is provided in the needle mount 104A of the injector 11A4, such that a distance L6 between the point of the needle 103A and the stopper 105 is smaller than the distance L2 between the inner bottom surface of the well 7 of the ink bottle 1 and the top edge of the opening 3 of the ink bottle 1 and greater than a distance L5 between the top edge of the opening 3 of the ink bottle 1 and the highest position of the inner bottom surface 6 of the ink bottle 1 (e.g., L2>L6>L5). The stopper 105 of the injector 11A4 has a diameter L7 greater than a diameter L1 of the opening 3 of the ink bottle 1.

When the ink refill kit 100F is used, as illustrated in FIGS. 18A and 18B, the narrow tube portion 103U (depicted in FIG. 17) of the injector 11A4 may be inserted into the container 2 of the ink bottle 1 through the opening 3 of the ink bottle 1, so that the injector 11A4 may siphon the ink 10 from the ink bottle 1.

According to this exemplary embodiment, since the stopper 105 is provided in a middle of the narrow tube portion 103U of the injector 11A4, and the diameter L7 of the stopper 105 is greater than the diameter L1 of the opening 3 of the ink bottle 1, the stopper 105 of the injector 11A4 may contact the top edge of the opening 3 of the ink bottle 1E, as illustrated in FIG. 18B. When the stopper 105 of the injector 11A4 contacts the opening 3 of the ink bottle 1, since the distance L6 (depicted in FIG. 17) between the point of the needle 103A and the stopper 105 is smaller than the distance L2 between the inner bottom surface of the well 7 of the ink bottle 1 and the top edge of the opening 3 of the ink bottle 1 and greater than the distance L5 between the top edge of the opening 3 of the ink bottle 1 and the highest position of the inner bottom surface 6 of the ink bottle 1, the point of the needle 103A of the injector 11A4 may reach the well 7 of the ink bottle 1, so that the injector 11A4 may siphon the ink 10 collected in the well 7 of the ink bottle 1, while preventing bending of the point of the needle 103A of the injector 11A4 due to excessive insertion of the injector 11A4 into the ink bottle 1.

Figure 19:
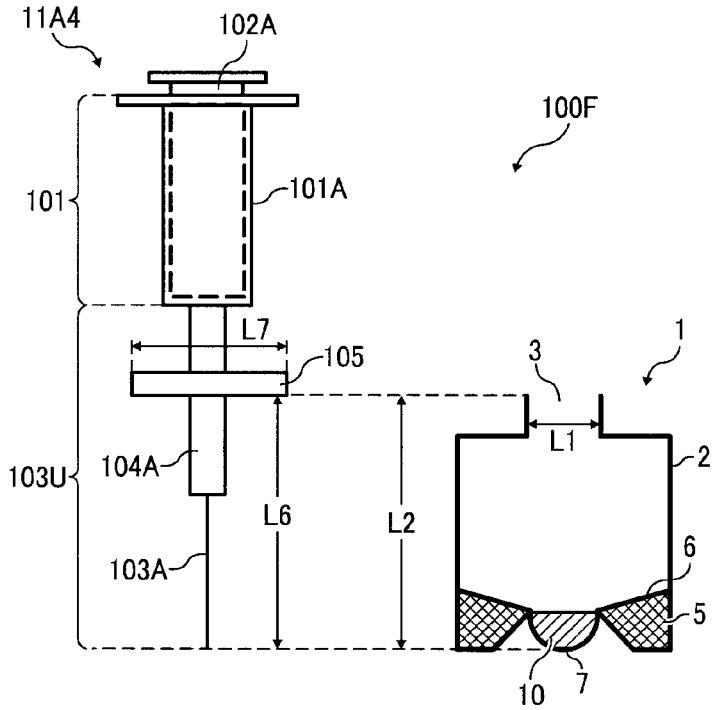
FIG. 19 is a schematic view of a modification example of the ink refill kit shown in FIG. 17.
Figure 20A:
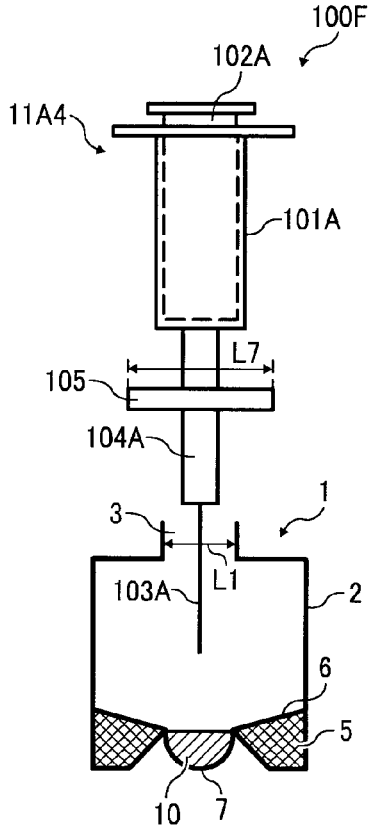
FIG. 20A is a sectional view of the ink refill kit shown in FIG. 19 when an injector included in the ink refill kit is inserted into an ink bottle included in the ink refill kit.
Figure 20B:
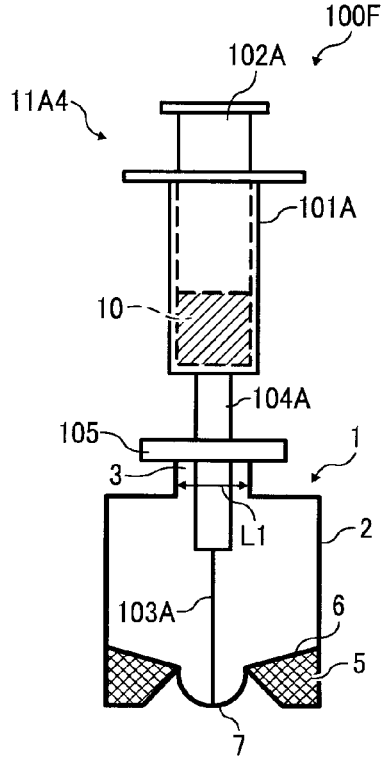
FIG. 20B is a sectional view of the ink refill kit shown in FIG. 20A when the injector shown in FIG. 20A siphons ink from the ink bottle shown in FIG. 20A.

Referring to FIGS. 19, 20A, and 20B, a description is now given of the ink refill kit 100F according to yet another exemplary embodiment. FIG. 19 is a schematic view of the ink refill kit 100F. FIG. 20A illustrates the ink refill kit 100F when the injector 11A4 is inserted into the ink bottle 1. FIG. 20B illustrates the ink refill kit 100F when the injector 11A4 siphons the ink 10 from the ink bottle 1.

According to this exemplary embodiment, as illustrated in FIG. 19, a distance L6 between the point of the needle 103A and the stopper 105 is equivalent to a distance L2 between the inner bottom surface of the well 7 of the ink bottle 1 and the top edge of the opening 3 of the ink bottle 1. The stopper 105 of the injector 11A4 has a diameter L7 greater than a diameter L1 of the opening 3 of the ink bottle 1.

When the ink refill kit 100F is used, as illustrated in FIGS. 20A and 20B, the narrow tube portion 103U (depicted in FIG. 19) of the injector 11A4 may be inserted into the container 2 of the ink bottle 1 through the opening 3 of the ink bottle 1, so that the injector 11A4 may siphon the ink 10 from the ink bottle 1.

According to this exemplary embodiment, since the stopper 105 is provided in a middle of the narrow tube portion 103U of the injector 11A4, such that the diameter L7 of the stopper 105 is greater than the diameter L1 of the opening 3 of the ink bottle 1, the stopper 105 of the injector 11A4 may contact the top edge of the opening 3 of the ink bottle 1, as illustrated in FIG. 20B. When the stopper 105 of the injector 11A4 contacts the opening 3 of the ink bottle 1, since the distance L6 between the point of the needle 103A and the stopper 105 is equivalent to the distance L2 between the inner bottom surface of the well 7 of the ink bottle 1 and the top edge of the opening 3 of the ink bottle 1, as illustrated in FIG. 19, the point of the needle 103A of the injector 11A4 may reach the well 7 of the ink bottle 1, so that the injector 11A4 may siphon the ink 10 collected in the well 7 of the ink bottle 1, while preventing bending of the point of the needle 103A of the injector 11A4 due to excessive insertion of the injector 11A4 into the ink bottle 1.

Figure 21:
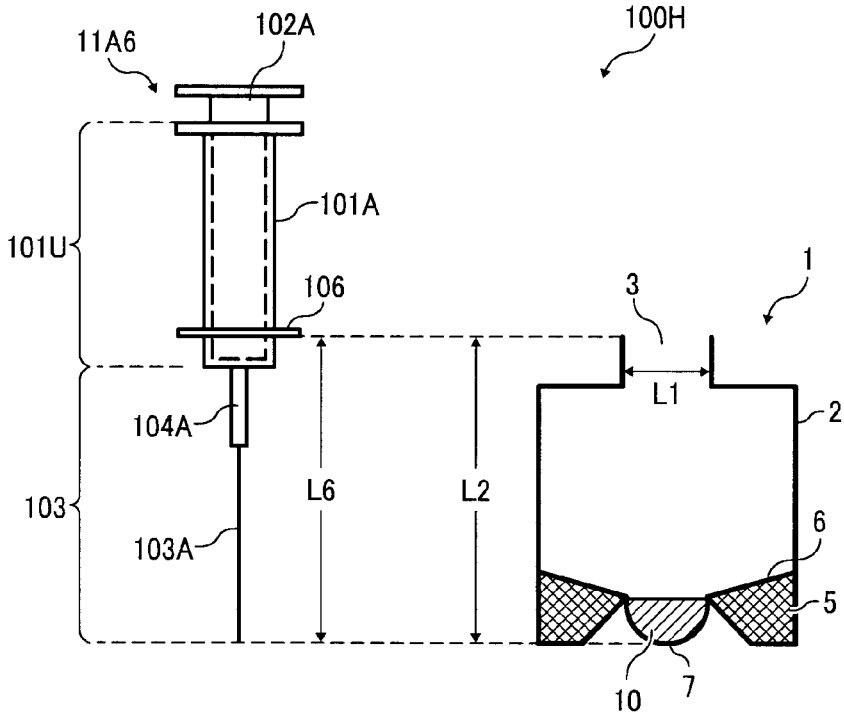
FIG. 21 is a schematic view of an ink refill kit according to yet another exemplary embodiment.
Figure 22A:
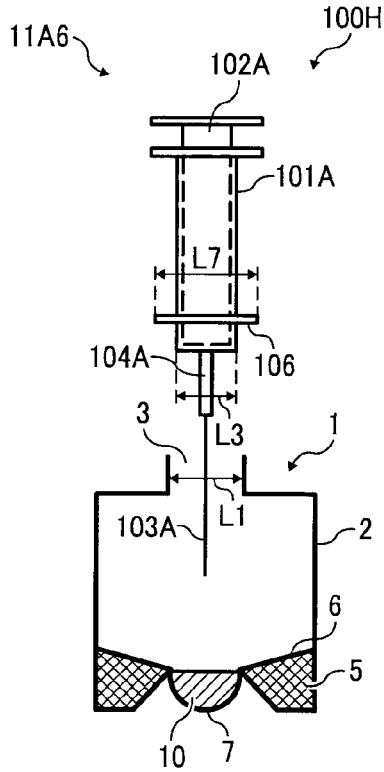
FIG. 22A is a sectional view of the ink refill kit shown in FIG. 21 when an injector included in the ink refill kit is inserted into an ink bottle included in the ink refill kit.
Figure 22B:
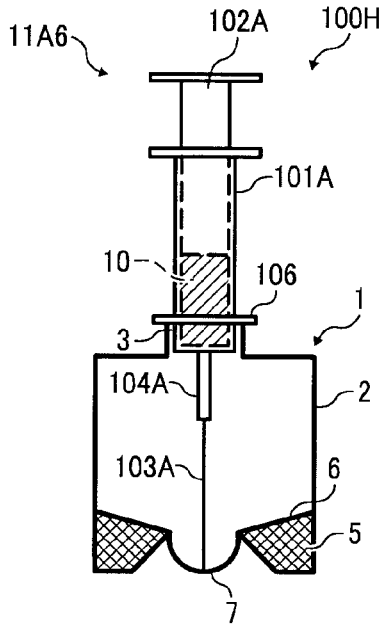
FIG. 22B is a sectional view of the ink refill kit shown in FIG. 22A when the injector shown in FIG. 22A siphons ink from the ink bottle shown in FIG. 22A.

Referring to FIGS. 21, 22A, and 22B, a description is now given of an ink refill kit 100H according to yet another exemplary embodiment. FIG. 21 is a schematic view of the ink refill kit 100H. The ink refill kit 100H includes an injector 11A6. The injector 11A6 includes a body portion 101U. The body portion 101U includes a stopper 106. The other elements of the ink refill kit 100H are equivalent to those of the ink refill kit 100 depicted in FIG. 2. FIG. 22A illustrates the ink refill kit 100H when the injector 11A6 is inserted into the ink bottle 1. FIG. 22B illustrates the ink refill kit 100H when the injector 11A6 siphons the ink 10 from the ink bottle 1.

As illustrated in FIG. 21, the cylinder 101A, the piston 102A, and the stopper 106 form the body portion 101U of the injector 11A6.

According to this exemplary embodiment, as illustrated in FIG. 21, the stopper 106 is provided on an outer circumferential surface of the cylinder 101A. A distance L6 between a point of the needle 103A and the stopper 106 of the injector 11A6 is equivalent to a distance L2 between the inner bottom surface of the well 7 of the ink bottle 1 and the top edge of the opening 3 of the ink bottle 1. Further, as illustrated in FIG. 22A, the stopper 106 of the injector 11A6 has a diameter L7 greater than a diameter L1 of the opening 3 of the ink bottle 1, while the cylinder 101A of the injector 11A6 has a diameter L3 smaller than the diameter L1 of the opening 3 of the ink bottle 1.

When the ink refill kit 100H is used, as illustrated in FIGS. 22A and 22B, the narrow tube portion 103 and a part of the body portion 101U (depicted in FIG. 21) of the injector 11A6 may be inserted into the container 2 of the ink bottle 1 through the opening 3 of the ink bottle 1, so that the injector 11A6 may siphon the ink 10 from the ink bottle 1.

According to this exemplary embodiment, since the stopper 106 is provided in a middle of the body portion 101U of the injector 11A6, such that the diameter L7 of the stopper 106 is greater than the diameter L1 of the opening 3 of the ink bottle 1, the stopper 106 of the injector 11A6 may contact the top edge of the opening 3 of the ink bottle 1, as illustrated in FIG. 22B. When the stopper 106 of the injector 11A6 contacts the opening 3 of the ink bottle 1, since the distance L6 between the point of the needle 103A and the stopper 106 is equivalent to the distance L2 between the inner bottom surface of the well 7 of the ink bottle 1 and the top edge of the opening 3 of the ink bottle 1, the point of the needle 103A of the injector 11A6 may reach the well 7 of the ink bottle 1, so that the injector 11A6 may siphon the ink 10 collected in the well 7 of the ink bottle 1, while preventing bending of the point of the needle 103A of the injector 11A6 due to excessive insertion of the injector 11A6 into the ink bottle 1.

Figure 23:
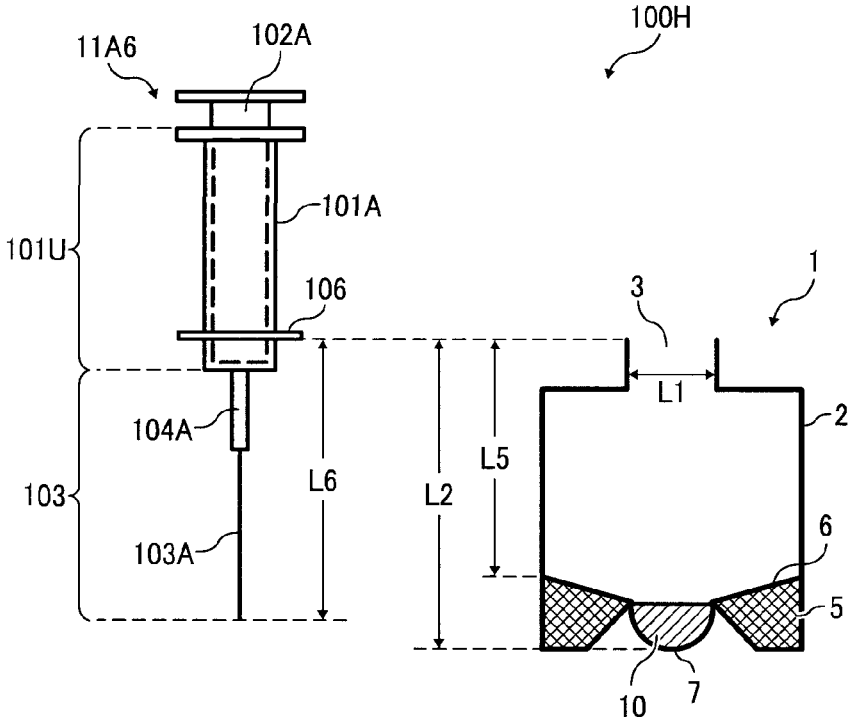
FIG. 23 is a schematic view of a modification example of the ink refill kit shown in FIG. 21.
Figure 24A:
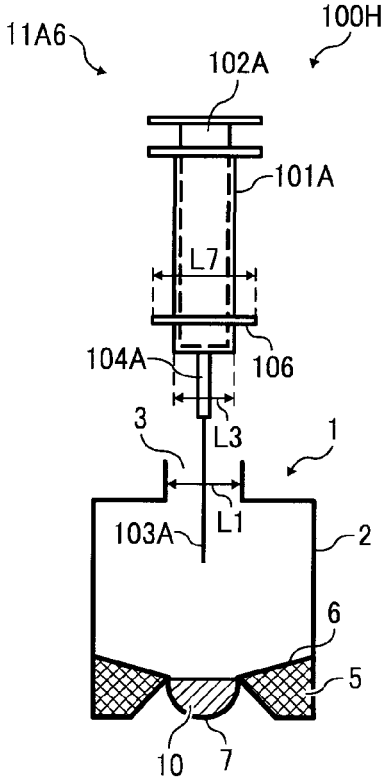
FIG. 24A is a sectional view of the ink refill kit shown in FIG. 23 when an injector included in the ink refill kit is inserted into an ink bottle included in the ink refill kit.
Figure 24B:
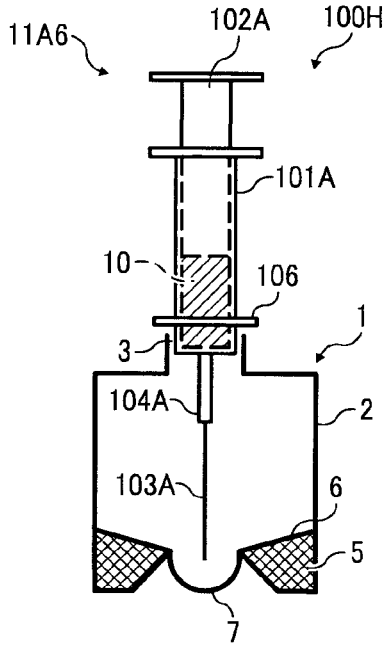
FIG. 24B is a sectional view of the ink refill kit shown in FIG. 24A when the injector shown in FIG. 24A siphons ink from the ink bottle shown in FIG. 24A.

Referring to FIGS. 23, 24A, and 24B, a description is now given of the ink refill kit 100H according to yet another exemplary embodiment. FIG. 23 is a schematic view of the ink refill kit 100H. FIG. 24A illustrates the ink refill kit 100H when the injector 11A6 is inserted into the ink bottle 1. FIG. 24B illustrates the ink refill kit 100H when the injector 11A6 siphons the ink 10 from the ink bottle 1.

According to this exemplary embodiment, as illustrated in FIG. 23, a distance L6 between a point of the needle 103A and the stopper 106 is smaller than a distance L2 between the inner bottom surface of the well 7 of the ink bottle 1 and the top edge of the opening 3 of the ink bottle 1 and greater than a distance L5 between the top edge of the opening 3 of the ink bottle 1 and the highest portion of the inner bottom surface 6 of the ink bottle 1 (e.g., L2>L6>L5). Further, as illustrated in FIG. 24A, the stopper 106 of the injector 11A6 has a diameter L7 greater than a diameter L1 of the opening 3 of the ink bottle 1, while the cylinder 101A of the injector 11A6 has a diameter L3 smaller than the diameter L1 of the opening 3 of the ink bottle 1.

When the ink refill kit 100H is used, as illustrated in FIGS. 24A and 24B, the narrow tube portion 103 (depicted in FIG. 23) of the injector 11A6 and a part of the body portion 101U may be inserted into the container 2 of the ink bottle 1 through the opening 3 of the ink bottle 1, so that the injector 11A6 may siphon the ink 10 from the ink bottle 1.

According to this exemplary embodiment, since the stopper 106 is provided in a middle of the body portion 101U of the injector 11A6, such that the diameter L7 of the stopper 106 is greater than the diameter L1 of the opening 3 of the ink bottle 1, the stopper 106 of the injector 11A6 may contact the top edge of the opening 3 of the ink bottle 1. Further, when the stopper 106 of the injector 11A6 contacts the opening 3 of the ink bottle 1, since the distance L6 (depicted in FIG. 23) between the point of the needle 103A and the stopper 106 is smaller than the distance L2 (depicted in FIG. 23) between the inner bottom surface of the well 7 of the ink bottle 1 and the top edge of the opening 3 of the ink bottle 1 and greater than the distance L5 (depicted in FIG. 23) between the top edge of the opening 3 of the ink bottle 1 and the highest portion of the inner bottom surface 6 of the ink bottle 1, the point of the needle 103A of the injector 11A6 may reach the well 7 of the ink bottle 1, so that the injector 11A6 may siphon the ink 10 collected in the well 7 of the ink bottle 1, while preventing bending of the point of the needle 103A of the injector 11A6 due to excessive insertion of the injector 11A6 into the ink bottle 1.

Figure 25:
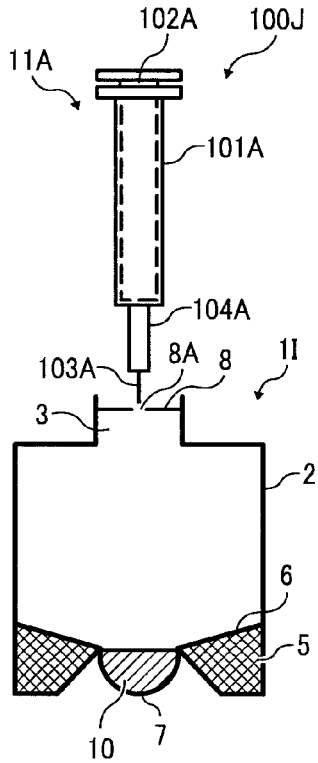
FIG. 25 is a schematic view of an ink refill kit according to yet another exemplary embodiment.
Figure 26A:
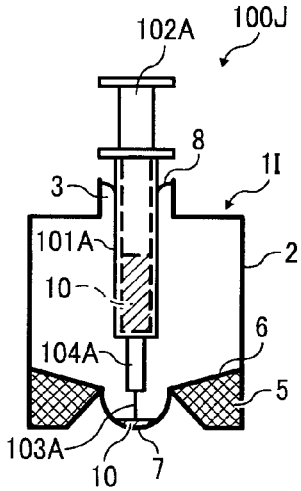
FIG. 26A is a sectional view of the ink refill kit shown in FIG. 25 when an injector included in the ink refill kit siphons ink from an ink bottle included in the ink refill kit.
Figure 26B:
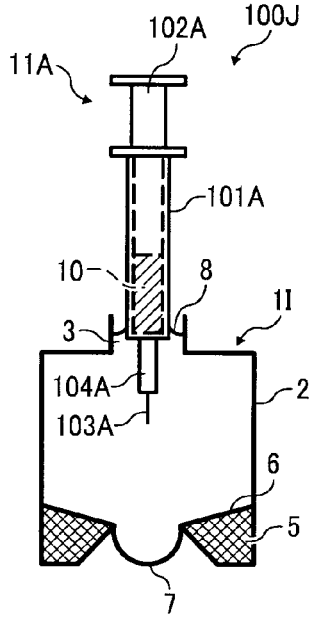
FIG. 26B is a sectional view of the ink refill kit shown in FIG. 26A when the injector shown in FIG. 26A is removed out of the ink bottle shown in FIG. 26A.

Referring to FIGS. 25, 26A, and 26B, a description is now given of an ink refill kit 100J according to yet another exemplary embodiment. FIG. 25 is a schematic view of the ink refill kit 100J. The ink refill kit 100J includes an ink bottle 1I. The ink bottle 1I includes a wiper 8. The wiper 8 includes a hole 8A. The other elements of the ink refill kit 100J are equivalent to those of the ink refill kit 100 depicted in FIG. 2. FIG. 26A illustrates the ink refill kit 100J when the injector 11A is inserted into the ink bottle 1I. FIG. 26B illustrates the ink refill kit 100J when the injector 11A siphons the ink 10 from the ink bottle 1I.

According to this exemplary embodiment, the wiper 8 is provided in the opening 3 of the ink bottle 1I and includes a flexible member (e.g., an elastic rubber). The hole 8A of the wiper 8 has a diameter smaller than that of the body portion 101 (depicted in FIG. 4) of the injector 11A.

When the ink refill kit 100J is used, as illustrated in FIGS. 26A and 26B, the cylinder 101A of the body portion 101 of the injector 11A is inserted into the container 2 of the ink bottle 1I through the hole 8A of the wiper 8 of the ink bottle 1I, so that the injector 11A may siphon the ink 10 from the ink bottle 1I. After siphoning the ink 10, the injector 11A is removed out of the container 2.

As illustrated in FIGS. 26A and 26B, since the wiper 8 contacts an outer circumferential surface of the cylinder 101A of the injector 11A, even when the ink 10 adheres to the outer circumferential surface of the cylinder 101A, the wiper 8 may wipe off the adhering ink 10.

That is, when a sufficient amount of ink 10 still remains in the ink bottle 1I, if the body portion 101 of the injector 11A is excessively inserted into the ink bottle 1I, the ink 10 may adhere to the outer circumferential surface of the cylinder 101A. However, the wiper 8 may wipe off the ink 10 adhering to the outer circumferential surface of the cylinder 101A, thereby preventing the ink 10 from adhering to the user's hand or other peripheral devices. Also, even though the wiper 8 includes the hole 8A, the wiper 8 may function as an inner lid to reduce evaporation of the ink 10 from the ink bottle 1I.

In addition, when a peripheral area of the hole 8A of the wiper 8 has a thickness smaller than that of an area other than the peripheral area of the hole 8A, the wiper 8 may efficiently wipe the ink 10 adhering to the injector 11A. Further, in order to smoothly insert the injector 11A into the ink bottle 1I and remove the injector 11A from the ink bottle 1I so as to efficiently take the ink 10 from the ink bottle 1I, a center of the hole 8A of the wiper 8 may be provided above (e.g., immediately above or directly above) the well 7 of the ink bottle 1I, thereby properly guiding the point of the needle 103A of the injector 11A to the well 7 of the ink bottle 1I. Moreover, the wiper 8 may include an air vent (not shown) for allowing air to flow out of the ink bottle 1I when the injector 11A is inserted into the ink bottle 1I.

In addition, the container 2 of the ink bottle 1I may include a transparent material, so that the user may observe the ink 10 dripping down in the ink bottle 1I.

Figure 27:
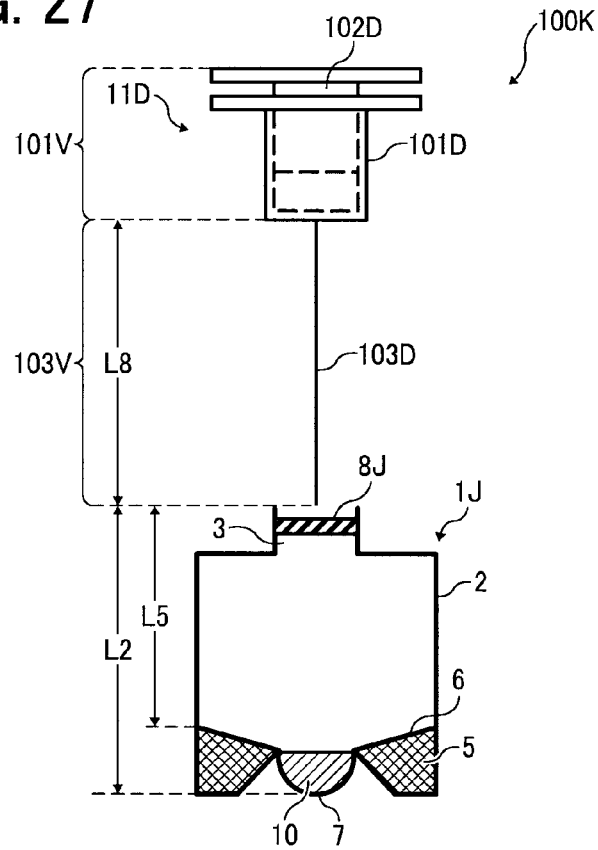
FIG. 27 is a schematic view of an ink refill kit according to yet another exemplary embodiment.
Figure 28A:
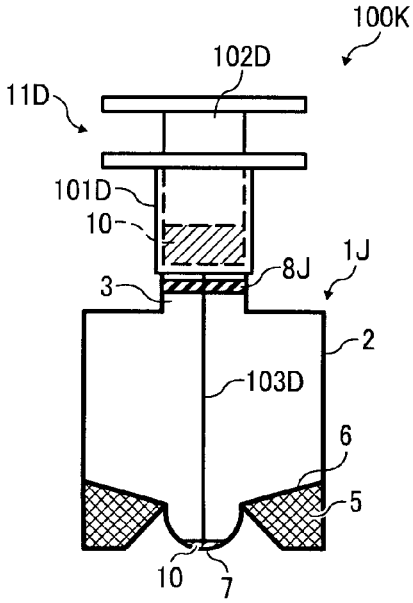
FIG. 28A is a sectional view of the ink refill kit shown in FIG. 27 when an injector included in the ink refill kit siphons ink from an ink bottle included in the ink refill kit.
Figure 28B:
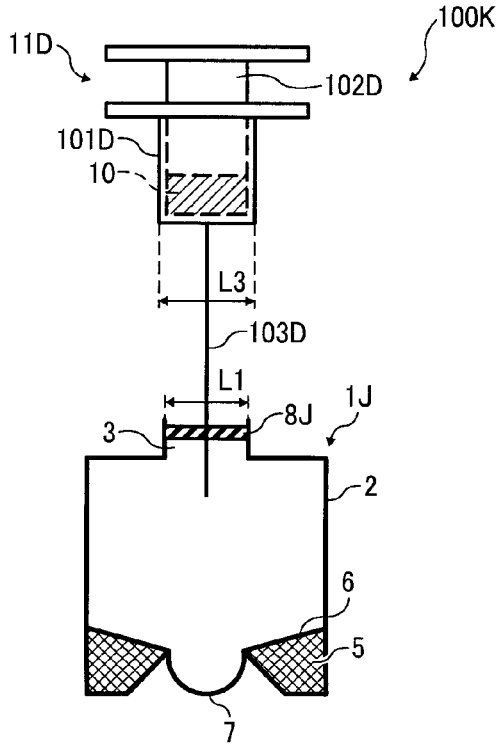
FIG. 28B is a sectional view of the ink refill kit shown in FIG. 28A when the injector shown in FIG. 28A is removed out of the ink bottle shown in FIG. 28A.

Referring to FIGS. 27, 28A, and 28B, a description is now given of an ink refill kit 100K according to yet another exemplary embodiment. FIG. 27 is a schematic view of the ink refill kit 100K. The ink refill kit 100K includes an injector 11D and an ink bottle 1J. The injector 11D includes a body portion 101V and a narrow tube portion 103V. The body portion 101V includes a cylinder 101D and a piston 102D. The narrow tube portion 103V includes a needle 103D. The ink bottle 1J includes a wiper 8J. The ink bottle 1J further includes the container 2, the opening 3, the leg portion 5, the inner bottom surface 6, and the well 7, which are included in the ink refill kit 100 depicted in FIG. 2. FIG. 28A illustrates the ink refill kit 100K when the injector 11D is inserted into the ink bottle 1J. FIG. 28B illustrates the ink refill kit 100K when the injector 11D siphons the ink 10 from the ink bottle 1J.

As illustrated in FIG. 27, the piston 102D slidably moves up and down inside the cylinder 101D. The needle 103D is attached to one end of the cylinder 101D opposite to another end through which the piston 102D is inserted into the cylinder 101D. The needle 103D includes a through-hole (not shown) connected to an inside of the cylinder 101D. The needle 103D of the injector 11D has a length L8 equivalent to a distance L2 between the inner bottom surface of the well 7 of the ink bottle 1J and the top edge of the opening 3 of the ink bottle 1J. Alternatively, the length L8 of the needle 103D may be smaller than the distance L2 between the inner bottom surface of the well 7 of the ink bottle 1J and the top edge of the opening 3 of the ink bottle 1J and greater than a distance L5 between the top edge of the opening 3 of the ink bottle 1J and the highest position of the inner bottom surface 6 of the ink bottle 1J (e.g., L2>L8>L5). Further, as illustrated in FIG. 28B, the cylinder 101D has a diameter L3 greater than a diameter L1 of the opening 3 of the ink bottle 1J.

The wiper 8J of the ink bottle 1J is provided at the opening 3 of the ink bottle 1J and includes a flexible member (e.g., an elastic rubber).

When the ink refill kit 100K is used, as illustrated in FIGS. 28A and 28B, the needle 103D of the injector 11D is inserted into the ink bottle 1J through the wiper 8J of the ink bottle 1J. After the injector 11D siphons the ink 10 from the ink bottle 1J, when the needle 103D of the injector 11D is removed from the ink bottle 1J, the ink 10 may adhere to the needle 103D. However, the wiper 8J may wipe off the ink 10 adhering to the needle 103D, thereby preventing the ink 10 from adhering to the user's hand or other peripheral devices. In addition, when the needle 103D is removed from the ink bottle 1J through the wiper 8J, an elastic force of the wiper 8J may close a hole formed by the needle 103D inserted into the ink bottle 1J. Thus, the wiper 8J may function as an inner lid of the ink bottle 1J, thereby reducing evaporation of the ink 10 from the ink bottle 1J.

Alternatively, the wiper 8J may include a hole. However, the hole may be small sufficient to allow the needle 103D to pass through. When the needle 103D has a diameter enough to pierce through the wiper 8J, the wiper 8J may not include the hole in advance.

The point of the needle 103D may preferably include an opening provided on the circumferential surface of the needle 103D (e.g., the ink inlet 109D depicted in FIG. 12D), thereby preventing the point of the needle 103D from being clogged with a material (e.g., the elastic rubber) of the wiper 8J.

Like the wiper 8 depicted in FIG. 25, the needle 103D may preferably pierce through the wiper 8J at a position above the well 7 of the ink bottle 1J. Therefore, when the wiper 8J does not include a hole in advance, a mark or a depression and the like may be provided at a proper position of the wiper 8J instead of the hole, so as to catch the point of the needle 103D. Also, the wiper 8J may preferably include an air vent (not shown) for allowing air to flow out of the ink bottle 1J.

Figure 29:
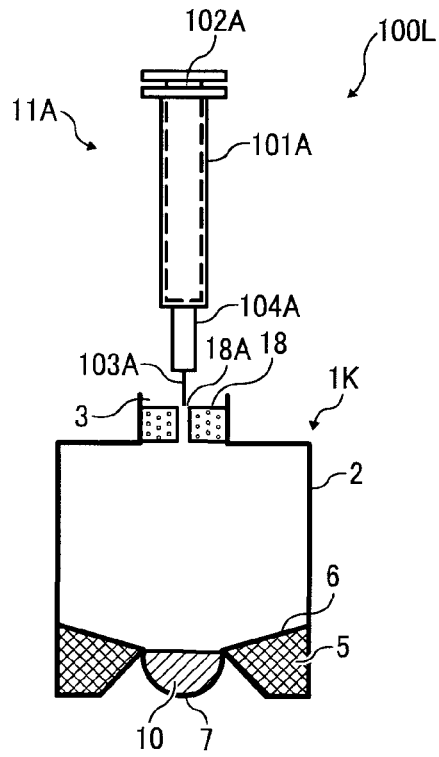
FIG. 29 is a schematic view of an ink refill kit according to yet another exemplary embodiment.
Figure 30A:
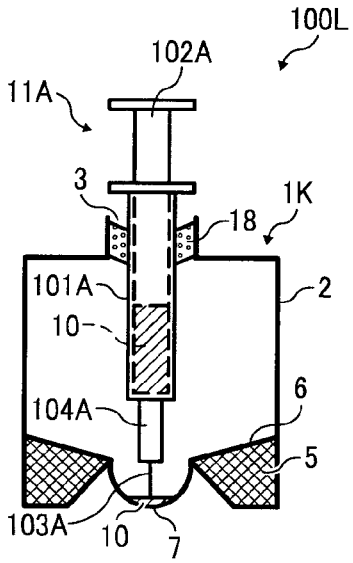
FIG. 30A is a sectional view of the ink refill kit shown in FIG. 29 when an injector included in the ink refill kit siphons ink from an ink bottle included in the ink refill kit.
Figure 30B:
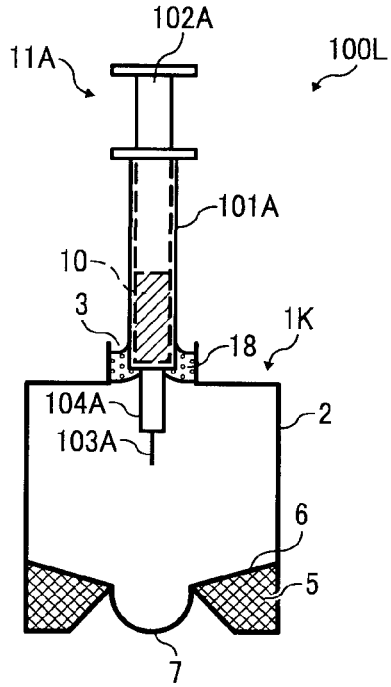
FIG. 30B is a sectional view of the ink refill kit shown in FIG. 30A when the injector shown in FIG. 30A is removed out of the ink bottle shown in FIG. 30A.

Referring to FIGS. 29, 30A, and 30B, a description is now given of an ink refill kit 100L according to yet another exemplary embodiment. FIG. 29 is a schematic view of the ink refill kit 100L. The ink refill kit 100L includes an ink bottle 1K. The ink bottle 1K includes a wiper 18. The wiper 18 includes a hole 18A. The other elements of the ink refill kit 100L are equivalent to those of the ink refill kit 100 depicted in FIG. 2. FIG. 30A illustrates the ink refill kit 100L when the injector 11A is inserted into the ink bottle 1K. FIG. 30B illustrates the ink refill kit 100L when the injector 11A siphons the ink 10 from the ink bottle 1K.

As illustrated in FIG. 29, according to this exemplary embodiment, the wiper 18 is provided in the opening 3 of the ink bottle 1K and includes an absorbable porous member (e.g., a sponge). The hole 18A of the wiper 18 has a diameter smaller than that of the cylinder 101A of the injector 11A.

Since the wiper 18 includes the absorbable member, even when the ink 10 adheres to an outer circumferential surface and the like of the cylinder 101A of the injector 11A, the wiper 18 may absorb the ink 10 adhering to the outer circumferential surface of the injector 11A, thereby preventing the ink 10 from returning to the ink bottle 1K, so that, the ink 10 may not mix with fresh ink in the ink bottle 1K.

Figure 31:
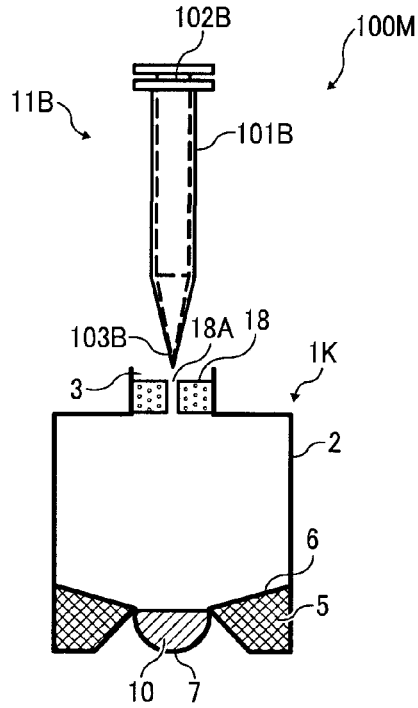
FIG. 31 is a schematic view of an ink refill kit according to yet another exemplary embodiment.
Figure 32A:
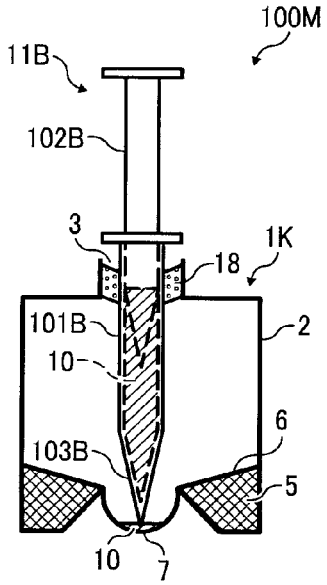
FIG. 32A is a sectional view of the ink refill kit shown in FIG. 31 when an injector included in the ink refill kit siphons ink from an ink bottle included in the ink refill kit.
Figure 32B:
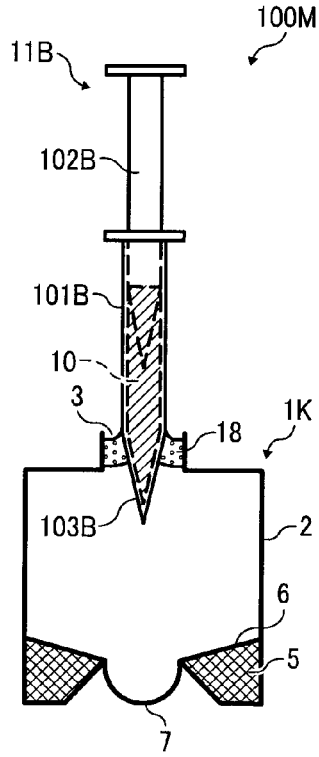
FIG. 32B is a sectional view of the ink refill kit shown in FIG. 32A when the injector shown in FIG. 32A is removed out of the ink bottle shown in FIG. 32A.

Referring to FIGS. 31, 32A, and 32B, a description is now given of an ink refill kit 100M according to yet another exemplary embodiment. FIG. 31 is a schematic view of the ink refill kit 100M.

The ink refill kit 100M includes the ink bottle 1K (depicted in FIG. 29) and the injector 11B (depicted in FIG. 7).

FIG. 32A illustrates the ink refill kit 100M when the injector 11B is inserted into the ink bottle 1K. FIG. 32B illustrates the ink refill kit 100M when the injector 11B siphons the ink 10 from the ink bottle 1K.

Figure 33:
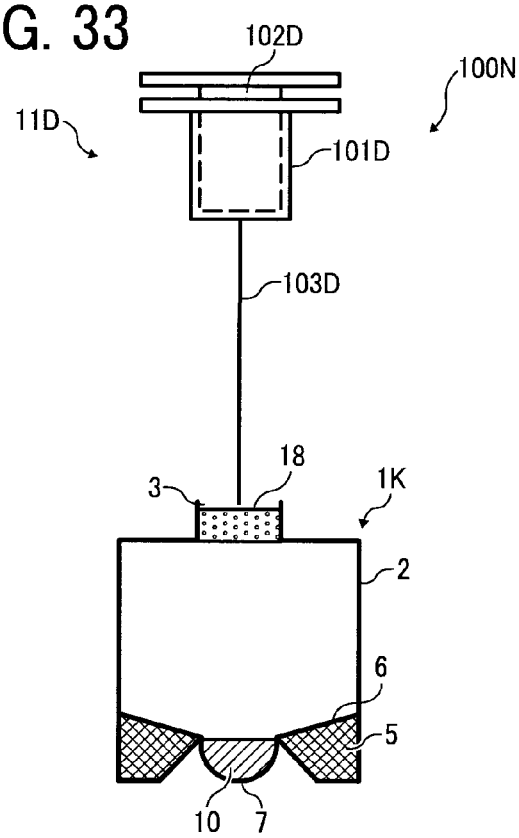
FIG. 33 is a schematic view of an ink refill kit according to yet another exemplary embodiment.
Figure 34A:
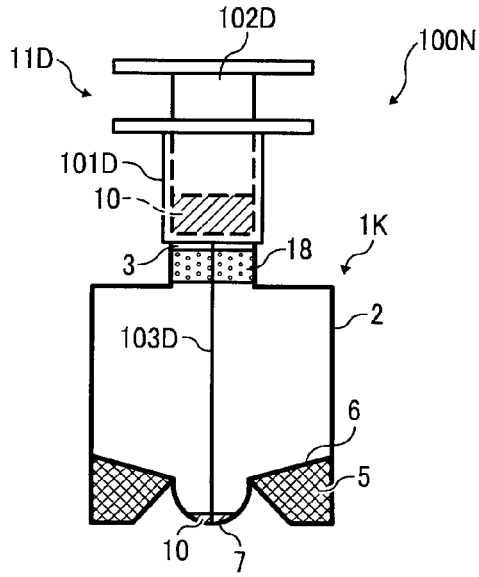
FIG. 34A is a sectional view of the ink refill kit shown in FIG. 33 when an injector included in the ink refill kit siphons ink from an ink bottle included in the ink refill kit.
Figure 34B:
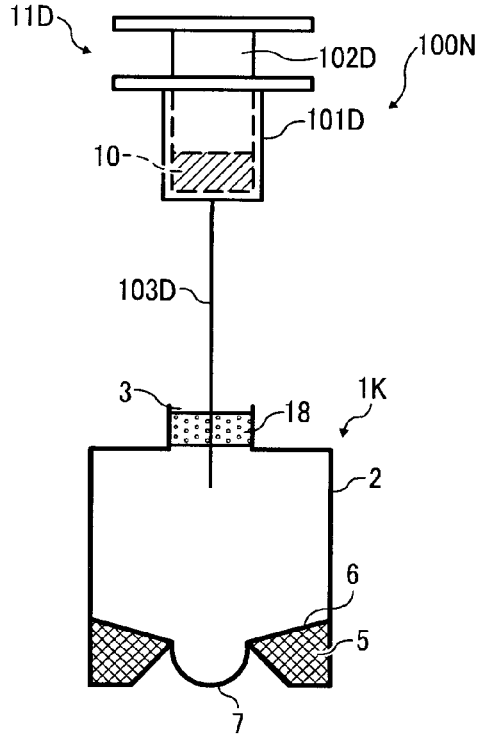
FIG. 34B is a sectional view of the ink refill kit shown in FIG. 34A when the injector shown in FIG. 34A is removed out of the ink bottle shown in FIG. 34A.

Referring to FIGS. 33, 34A, and 34B, a description is now given of an ink refill kit 100N according to yet another exemplary embodiment. FIG. 33 is a schematic view of the ink refill kit 100N.

The ink refill kit 100N includes the ink bottle 1K (depicted in FIG. 29) and the injector 11D (depicted in FIG. 27).

FIG. 34A illustrates the ink refill kit 100N when the injector 11D is inserted into the ink bottle 1K. FIG. 34B illustrates the ink refill kit 100N when the injector 11B siphons the ink 10 from the ink bottle 1D.

Figure 35:
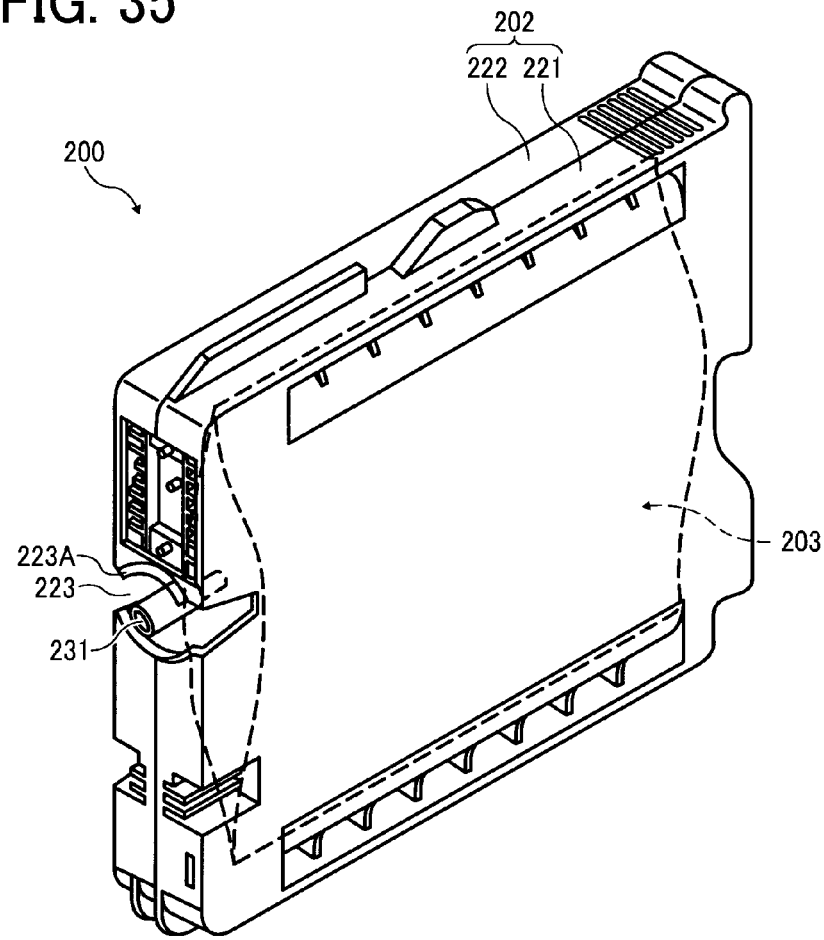
FIG. 35 is a schematic perspective view of an ink cartridge according to an exemplary embodiment.
Figure 36:
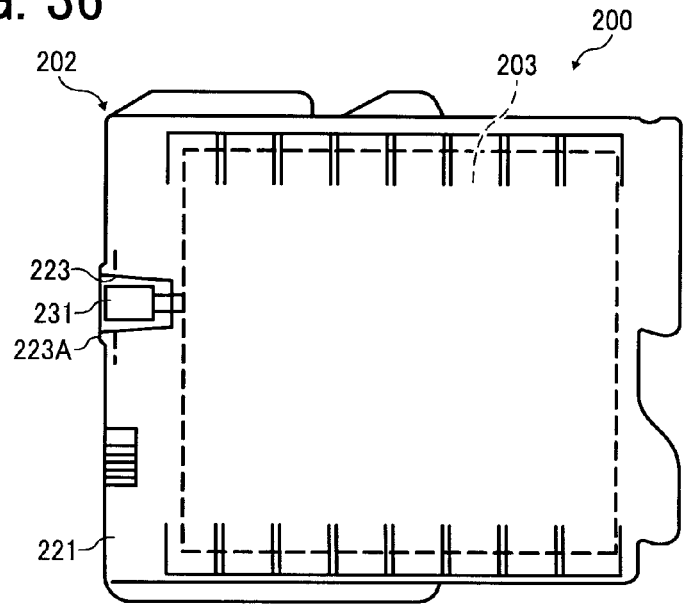
FIG. 36 is a side view of the ink cartridge shown in FIG. 35.

Referring to FIGS. 35 to 38, a description is now given of an ink cartridge 200 into which ink is supplied with any one of the above-described ink refill kits. FIG. 35 is a perspective view of the ink cartridge 200. FIG. 36 is a side view of the ink cartridge 200.

The ink cartridge 200 includes a cartridge case 202 and an ink bag 203. The cartridge case 202 includes a first case 221, a second case 222, an opening 223, and a rib 223A. The ink bag 203 includes an ink supply inlet 231.

Figure 37:
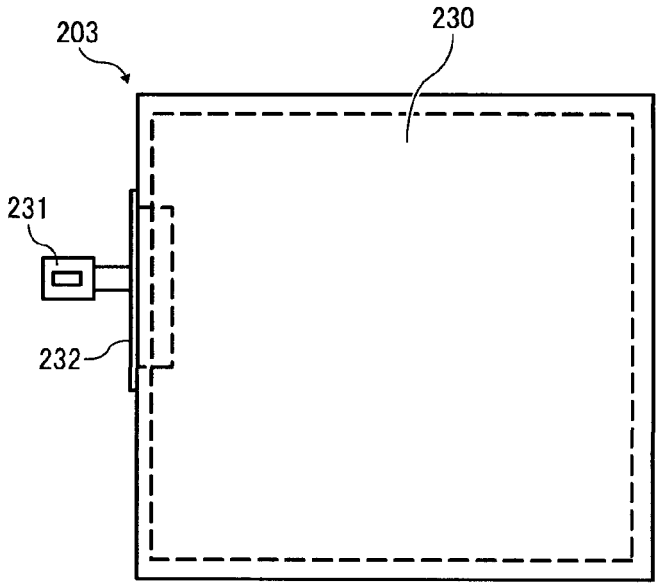
FIG. 37 is a side view of an ink bag included in the ink cartridge shown in FIG. 36.

FIG. 37 is a side view of the ink bag 203. The ink bag 203 further includes an ink bag body 230 and a holding member 232.

As illustrated in FIG. 35, the ink bag 203, serving as a recording liquid storing member, is provided inside the cartridge case 202 and stores ink inside. The first case 221 and the second case 222 form the cartridge case 202 and may be assembled and disassembled.

The opening 223 of the cartridge case 202 corresponds to the ink supply inlet 231 of the ink bag 203, and is formed by combining a semicircular opening of the first case 221 with a semicircular opening of the second case 222. The rib 223A is provided around the opening 223 of the cartridge case 202.

For example, when the ink cartridge 200 is mounted on an image forming apparatus (not shown), a hollow needle of the image forming apparatus is pierced into the ink bag 203 through the ink supply inlet 231, so as to supply ink stored in the ink bag 203 to the image forming apparatus.

As illustrated in FIG. 37, the ink bag 230 includes an aluminum coated flexible film and has a substantially square shape (e.g., a rectangular shape). The holding member 232 of the ink bag 203 includes a resin and is fixed (e.g., welded) to one side of the ink bag 230. The ink supply inlet 231 is provided on the holding member 232. Therefore, when the holding member 232 is engaged in the cartridge case 202 (depicted in FIG. 35), the holding member 232 may hold the ink bag 203 in a predetermined position in the cartridge case 202.

Figure 38:
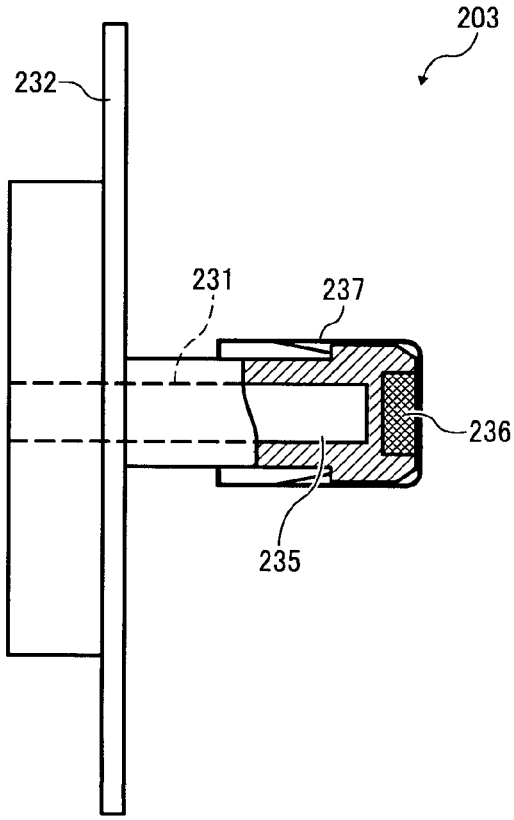
FIG. 38 is an enlarged sectional view of an ink supply inlet included in the ink bag shown in FIG. 37.

FIG. 38 is an enlarged sectional view of the ink supply inlet 231 included in the ink bag 203. The ink supply inlet 231 includes a through-hole 235, a sealing member 236, and a cap 237.

The through-hole 235 is provided inside the ink supply inlet 231. The sealing member 236 includes an elastic member (e.g., a rubber material such as silicon, fluorine, butyl, and the like) to seal the through-hole 235, and is embedded in one end of the ink supply inlet 231 and held by the cap 237.

For example, in order to supply the ink cartridge 200 with ink, after the injector 11A siphons the ink 10 from the ink bottle 1, as illustrated in FIG. 2, when the needle 103A of the injector 11A is inserted into the through-hole 235 (depicted in FIG. 38) through the sealing member 236 (depicted in FIG. 38) of the ink supply inlet 231 (depicted in FIG. 38) of the ink bag 203, the injector 11A may inject the ink into the ink bag 203 by pushing the piston 102A into the cylinder 101A.

The image forming apparatus may be a copier, a facsimile machine, a printer, a multifunction printer having at least one of copying, printing, scanning, and facsimile functions, or the like.

According to the above-described exemplary embodiments, the image forming apparatus includes an apparatus for forming an image by discharging liquid. A recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. Liquid, with which the image forming apparatus forms an image, is not limited to ink but includes any fluid and any substance which may form an image.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2007-158909 filed on Jun. 15, 2007 in the Japan Patent Office, the entire contents of which are hereby incorporated herein by reference.

What is claimed is:

1. An ink refill kit for injecting ink into an ink cartridge, comprising:

an ink bottle configured to store ink; and an injector configured to siphon the ink from the ink bottle and inject the ink into the ink cartridge, the ink bottle comprising:

an opening configured to allow the injector to pass therethrough;

an inner bottom surface provided on an inner bottom of the ink bottle; and a single deepest portion provided in the inner bottom surface opposite the opening and having a depth greater than that of the inner bottom surface.

2. The ink refill kit according to claim 1, wherein the injector comprises a body portion having an outer diameter smaller than an inner diameter of the opening of the ink bottle.

3. The ink refill kit according to claim 1, wherein the injector comprises:

a body portion; and a narrow tube portion having an outer diameter smaller than an inner diameter of the body portion and a length greater than a distance between a top edge of the opening of the ink bottle and the inner bottom surface of the ink bottle, so that a point of the injector reaches the deepest portion of the ink bottle.

4. The ink refill kit according to claim 1, wherein the injector comprises:

a body portion; and a narrow tube portion having an outer diameter smaller than an inner diameter of the body portion and comprising an ink inlet provided at one end of the narrow tube portion, the narrow tube portion having a length smaller than a distance between a top edge of the opening of the ink bottle and a bottom surface of the deepest portion of the ink bottle, so that the ink inlet reaches a position lower than a part of the inner bottom surface of the ink bottle when the ink bottle is set on a horizontal surface.

5. The ink refill kit according to claim 1, wherein the ink bottle further comprises a wiper configured to wipe off the ink adhering to the injector.

6. The ink refill kit according to claim 5, wherein the wiper comprises a through-hole provided above the deepest portion of the ink bottle.

* * * * *